US008905132B2

(12) United States Patent
Abbate et al.

(10) Patent No.: US 8,905,132 B2
(45) Date of Patent: Dec. 9, 2014

(54) ESTABLISHING COMMUNICATION BETWEEN WELL PAIRS IN OIL SANDS BY DILATION WITH STEAM OR WATER CIRCULATION AT ELEVATED PRESSURES

(75) Inventors: Jason P. Abbate, Calgary (CA); Chad Barber, Calgary (CA); Christopher James Elliott, Calgary (CA); Simon Gittins, Bragg Creek (CA); Logan Popko, Calgary (CA); Maliha Zaman, Calgary (CA)

(73) Assignee: FCCL Partnership, Calgary, Alberta (CA)

( * ) Notice: Subject to any disclaimer, the term of this patent is extended or adjusted under 35 U.S.C. 154(b) by 349 days.

(21) Appl. No.: 13/288,854

(22) Filed: Nov. 3, 2011

(65) Prior Publication Data

US 2013/0032336 A1 Feb. 7, 2013

Related U.S. Application Data

(60) Provisional application No. 61/515,539, filed on Aug. 5, 2011.

(51) Int. Cl.

| | |
|---|---|
| ***E21B 43/17*** | (2006.01) |
| ***E21B 43/18*** | (2006.01) |
| ***E21B 43/24*** | (2006.01) |
| ***E21B 43/30*** | (2006.01) |

(52) U.S. Cl.

CPC ..... *E21B 43/18* (2013.01); *E21B 43/2406* (2013.01); *E21B 43/24* (2013.01); *E21B 43/305* (2013.01)

USPC ..... 166/272.3; 166/272.2; 166/272.7; 166/250.1

(58) Field of Classification Search

CPC . E21B 43/24; E21B 43/2405; E21B 43/2406; E21B 43/2408

USPC ..... 166/272.3, 272.7, 306, 263, 302, 272.2, 166/271, 268, 252.1, 250.06, 52, 272.1

See application file for complete search history.

(56) References Cited

U.S. PATENT DOCUMENTS 3,583,488 A * 6/1971 Hutchison ..... 166/303
4,192,182 A * 3/1980 Sylvester ..... 73/152.39

(Continued)

FOREIGN PATENT DOCUMENTS

CA 1304287 6/1992
CA 2240786 6/2006

OTHER PUBLICATIONS

Collins, Geomechanical Effects on the SAGD Process, SPE/PS-CIM/CHOA-97905, SPE International et al.*

(Continued)

*Primary Examiner* — Jennifer H Gay
*Assistant Examiner* — George Gray
(74) *Attorney, Agent, or Firm* — Christie, Parker & Hale, LLP

(57) ABSTRACT

A method of establishing fluid communication between a well pair in an oil-sand reservoir, where dilatable oil sands in the reservoir form a barrier to fluid communication between the well pair. Steam or water is circulated within at least one well to a region of the oil sands adjacent to the well. The steam or water pressure is increased to a dilation pressure sufficient to dilate the oil sands in the region. While circulating steam or water within the well at a substantially steady state, the steam or water pressure is maintained at a level sufficient to enlarge the dilated region, until detection of a signal indicative of fluid communication between the well pair. The rates and pressures of steam or water injection and production may be monitored and adjusted to vary a bottom-hole pressure in the well.

24 Claims, 18 Drawing Sheets

(56) References Cited

U.S. PATENT DOCUMENTS

| | | | | |
|---|---|---|---|---|
| 4,344,485 | A | 8/1982 | Butler | |
| 5,215,146 | A | 6/1993 | Sanchez | |
| 6,257,334 | B1 | 7/2001 | Cyr et al. | |
| 7,866,395 | B2 | 1/2011 | Hocking | |
| 7,870,904 | B2 | 1/2011 | Hocking | |
| 2010/0243249 | A1 * | 9/2010 | Fang et al. | 166/272.3 |
| 2011/0174488 | A1 * | 7/2011 | Morris et al. | 166/305.1 |

OTHER PUBLICATIONS

Collins, Injection pressures for geomechanical enhancement of recovery processes in the Athabasca oil sands, SPE/PS-CIM/CHOA-79028, SPE International et al.*

Collins, "Geomechanical effects on the SAGD process", presented at the 2005 SPE International Thermal Operations and Heavy Oil Symposium held in Calgary, Alberta, Canada, Nov. 1-3, 2005, pp. 1-12.

Jiang et al., "Review of thermal recovery technologies for the Clearwater and Lower Grand Rapids formations in the Cold Lake area in Alberta", Proceedings of the Canadian International Petroleum Conference (CIPC), 2009, Calgary, Alberta, Canada, Jun. 16-18, 2009, pp. 1-16.

Li et al., "Steam injection pressure and the SAGD ramp-up process", Journal of Canadian Petroleum Technology, 2009, vol. 48, No. 1, pp. 1-6.

Olson et al., "Permeability changes due to shear dilatancy in uncemented sands", presented at the 43rd US Rock Mechanics Symposium and 4th U.S.-Canada Rock Mechanics Symposium, held in Asheville, NC, Jun. 28-Jul. 1, 2009, pp. 1-12.

Yuan and McFarlane, "Evaluation of Steam Circulation Strategies for SAGD Start-Up," Proceedings of the Canadian International Petroleum Conference (CIPC) 2009, Calgary, Alberta, Canada, Jun. 16-19, 2009, paper 2009-14, pp. 1-14.

Redford and Cotsworth, "Development of Communication Paths within a Tar Sand Bed", Am. Chem. Soc., Div. Fuel Chem., 1974, vol. 19, pp. 224-230.

Canadian Intellectual Property Office, "Office Action," Mar. 7, 2013, in related Canadian Patent Application No. 2,757,125.

Canadian Intellectual Property Office, "Notice of Allowance," Jun. 27, 2013, in related Canadian Patent Application No. 2,757,125.

Cenovus FCCL Ltd., "Application for Enhanced Start-up Application for the B03, B04, B05 and B07 Pads" submitted to Energy Resources Conservation Board and Alberta Environment, Nov. 2010.

EnCana FCCL Ltd., "Application for Dilation Start-up test at Christina Lake Thermal Project—Phase IB" submitted to Energy Resources Conservation Board and Alberta Environment, Jul. 2009.

* cited by examiner

ESTABLISHING COMMUNICATION BETWEEN WELL PAIRS IN OIL SANDS BY DILATION WITH STEAM OR WATER CIRCULATION AT ELEVATED PRESSURES

CROSS-REFERENCE TO RELATED APPLICATION

This application claims the benefit of, and priority from, U.S. patent application Ser. No. 61/515,539, filed Aug. 5, 2011, and entitled "Establishing Communication between Well Pairs in Oil Sands by Dilation with Steam or Water Circulation at Elevated Pressures," the entire contents of which are incorporated herein by reference.

FIELD OF THE INVENTION

The present invention relates generally to in situ processes for recovering hydrocarbon from oil sands, and particularly to steam-assisted in situ recovery processes.

BACKGROUND OF THE INVENTION

Some subterranean deposits of viscous petroleum can be extracted in situ by lowering the viscosity of the petroleum to mobilize it so that it can be moved to, and recovered from, a production well. Reservoirs of such deposits may be referred to as reservoirs of heavy hydrocarbon, heavy oil, bitumen, tar sands, or oil sands. The in situ processes for recovering oil from oil sands typically involve the use of multiple wells drilled into the reservoir, and are assisted or aided by injecting a heated fluid such as steam into the reservoir formation from an injection well. In some in situ recovery processes, it is necessary or desirable to establish fluid communication between different wells. For example, in a steam-assisted gravity drainage (SAGD) process, fluid communication between an injection and production well pair is typically established as part of the start-up operation before a steam chamber is developed above the injection well.

A typical SAGD process is disclosed in U.S. Pat. No. 4,344,485 to Butler ("Butler"). In the process disclosed in Butler, two wells are drilled into the deposit, one for injection of steam and one for production of oil and water. Steam is injected via the injection well to heat the formation. As the steam condenses and gives up its heat to the formation, the viscous hydrocarbons are mobilized and drain by gravity toward the production well. Mobilized viscous hydrocarbons are recovered continuously through the production well. The conditions are chosen so that a very large steam saturated volume known as a steam chamber is formed in the formation adjacent to the injection well. The injection well is connected to this chamber and steam is injected continuously so as to maintain pressure in the steam chamber. At the boundary of the chamber, steam condenses and heat is transferred by conduction into the cooler surrounding regions. The temperature of the oil adjacent to the chamber is increased and it drains downwards continuously by gravity, along with the hot steam condensate, to the production well. In Butler, thermal communication between the injection and production wells is established before commencing production of oil. According to Butler, thermal communication is established when a relatively high permeability path from the injection well to the production well is established so that liquids heated by injected steam can drain continuously to the production well. Butler teaches that thermal communication between the wells can be established quickly by fracturing, i.e., forming a vertical fracture between the injection and production well pair by employing steam pressure above the fracture pressure, or by hydraulically fracturing the reservoir and propping it using appropriate proppants. For example, where the fracture pressure of the formation is 1200 psig (about 8.4 MPa), steam is introduced at 1300 psig (about 9.1 MPa). A vertical fracture is formed in the deposit extending above and below each well. After the drainage process has begun and a steam chamber has formed, the steam injection rate is reduced and the steam chamber pressure is allowed fall to the desired operating value, typically in the range of 100-500 psig.

Another SAGD process is described in CA 1,304,287 to Edmunds et al. ("Edmunds"). In this process, a pair of horizontal parallel co-extensive wells, one spaced closely above the other, are completed so that they extend through a heavy oil reservoir in close proximity to its base. The upper well is referred to as the injector and the lower as the producer. Each well has a screened liner and an inner tubing string extending the length of the well. Steam is circulated separately through each of the wells to heat by conduction the span of formation extending between the wells, to establish fluid communication between them. The circulation is conducted in through the tubing and out through the annulus at a pressure that is below the fracture pressure. The rate of production of effluent from each well is controlled to maintain its temperature at about 10-40° C. below the saturated steam temperature. Once communication is established, steam circulation in the producer is discontinued and the well is produced through the tubing. Steam is then injected through both the annulus and tubing of the injector. Steam condensate and oil are produced through the lower well. Steam-assisted gravity drainage is the mechanism thereafter used to heat the reservoir and produce oil.

A further SAGD process is described in U.S. Pat. No. 5,215,146 to Sanchez ("Sanchez"). Sanchez notes that steam breakthrough between the well pair in a SAGD process is more likely to occur at the point of closest spacing of the two wells. After the initial breakthrough, two very long horizontal wells (say 500 meters) could have a short section of only 1 or 2 meters having steam communication. As a result, the steam chamber can now grow only slowly along the length of the well. For long wells a complete formation of a steam chamber along the length of the wellbore may take several months, thereby reducing the effectiveness of the long wellbore. To solve this problem, Sanchez proposes adding foam while injecting steam into the injection well once steam breakthrough occurs in an inter-well region between the injection and production well pair. Foam enters the inter-well region thereby causing an increased pressure gradient. This increased pressure gradient adds to the gravity force thereby providing a greater interstitial oil velocity which increases oil drainage between wells during startup. According to Sanchez, adding form can reduce the time during which steam moves in a lateral direction between the well pair.

Jian-Yang Yuan and Richard McFarlane reviewed various techniques for start-up procedure in SAGD processes in a paper entitled "Evaluation of Steam Circulation Strategies for SAGD Start-Up," *Proceedings of the Canadian International Petroleum Conference* (*CIPC*) 2009, Calgary, Alberta, Canada, 16-18 Jun., 2009, paper 2009-14 ("Yuan"). According to Yuan, the start-up procedure for SAGD requires the establishment of oil mobility between the well pair and requires that the intervening fluid between the well pair be heated to a temperature sufficiently high to cause the oil to flow from the injector to the producer. This is normally achieved by initially circulating steam in each well. The horizontal portion of each well can consist of tubing and liner, which provides two possible channels for fluid flow. In the simplest case, hot fluid can be injected into a steel tubing at the heel, flow from the heel to toe through the tubing, and then out through the annular space between tubing and liner from the toe towards the heel. The rate of heat transfer and fluid convection into the reservoir formation determine how communication is established along the length of the well pair. Once communication is established in a certain region along the well pair, drainage can be initiated in that region and subsequent steam injection will mainly be consumed by the steam chamber development around that region having the highest drainage rate. Ideally, it is desirable that this drainage region cover the entire length of the well pair. Depending on reservoir characteristics, this initial communication and drainage impact early production rate and even ultimate recovery. It is expected that steam injection rate, steam quality and the pressure drop between the two wells (ΔP) play critical roles. They also note that according to previous studies by others, no pressure differential between the well pair is required for start-up. When thermal conduction via steam circulation has heated the bitumen to between 50 and 100° C., the bitumen is sufficiently mobile so that it can be displaced by hot water and rapid convectional heating can occur. Under these conditions, and a small ΔP, steam breakthrough to the producer will take only a few days. Increasing the ΔP can increase fluid transport and convection; however this solution is not applicable once breakthrough has occurred anywhere along the well pair. Yuan notes that it is suggested by others that hot water injection could provide a better solution. The water will flow downwards, under gravity, from injector to producer more easily than water and bitumen resulting in a faster rate of heat transfer and communication. Yuan further notes that simulation analysis indicates that, for given tubing and liner sizes and reservoir properties, relatively lower circulation rates at high steam quality are more favorable for faster initialization and development of uniform temperature between the horizontal well pair; the use of high steam quality in combination with high circulation rates leads to slower rates of initialization, less uniform heating along the length of the wells, and possibility of premature steam breakthrough at the heel; and a small pressure difference (ΔP) between the well pair, offsetting the natural hydraulic pressure (50 kPa), appears to be more favorable for faster and more uniform initialization. They state that while a higher pressure difference can result in faster initialization, it can also result in less uniform heating and increasing the potential for premature steam breakthrough at the heel.

CA 2,240,786 to Lesage ("Lesage") discloses heating an oil-sand formation by injecting steam into a horizontal section of a well and circulating it back to the surface. In the Lesage process, steam is initially continuously circulated in and out of the horizontal wellbore at a pressure below the formation's fracture pressure thereby heating the formation surrounding the horizontal wellbore by conduction to reduce the viscosity of the viscous oil. This step is continued until the temperature of the horizontal wellbore reaches the saturation temperature of steam at the horizontal wellbore pressure. Thereafter, the production is ceased and a slug of steam is injected and accumulated in and around the horizontal section, still at a pressure below the formation's fracture pressure. The well is then shut-in and is allowed to soak for a period of time, preferably from 1 to 7 days. After the soak period, the well is then opened for production and the continuous injection of steam is resumed soon after oil appears in the produced fluids. Lesage teaches that it is important not to fracture the formation because once fractured, most of the injected steam will flow into the fracture thereby making it very difficult to heat the formation along the length of the horizontal wellbore. While circulating steam, the steam injection pressure and the steam circulation rate can be controlled by adjusting chokes positioned in injection tubing at the surface. Conditioning of the formation is considered complete when the temperature within the horizontal wellbore reaches the saturation temperature of the steam at horizontal wellbore pressure as measured at the surface. Another indicator of completion is when the produced steam contains substantial amounts of produced oil. This step of heating the formation can typically take from about 20 to 100 days or longer, depending on well and/or formation parameters, injection and production pressures, steam quality, and circulation rates. Lesage further teaches that after the formation surrounding horizontal wellbore has been conditioned (i.e. heated) and some voidage has been created in the formation, the production tubing is closed and the injection of steam is continued through injection tubing. This injected steam now has no way to return to the surface, and accumulates as a "slug" within and around the horizontal wellbore. Injection of steam continues until the bottom-hole pressure in the wellbore approaches (i.e. nearly equals) the fracture pressure of the formation. At this time, the injection of steam is ceased, the well is shut-in, and the formation is allowed to "soak" for a period of time. Allowing the formation to soak results in heat being transferred from the steam by convective heating in addition to conductive heating. Although steam is injected below the fracture pressure of the formation, some degree of local failure of sand in shear (dilation) takes place and is advantageous to the process as it facilitates the entering of steam into the formation, thus resulting in convective heating.

SUMMARY OF THE INVENTION

In accordance with an aspect of the present invention, there is provided a method of establishing fluid communication between a well pair in an oil-sand reservoir, the reservoir comprising dilatable oil sands forming a barrier to fluid communication between the well pair. The method comprises a) circulating steam within a well of the well pair to apply a steam pressure to a region of the oil sands adjacent to the well, wherein the circulating steam within the well comprises injecting steam into the well and producing steam from the same well; b) increasing the steam pressure to a dilation pressure sufficient to dilate the oil sands in the region; and c) while circulating steam within the well at a substantially steady state, maintaining the steam pressure at a level sufficient to enlarge the dilated region, until detection of a signal indicative of fluid communication between the well pair. The method may further comprise monitoring and adjusting a rate of steam injection into the well and a rate of steam production from the well, wherein the steam pressure may be controlled by adjusting the rate of steam injection or the rate of steam production to vary a bottom-hole pressure in the well. The rate of steam production may be adjusted to vary the bottom-hole pressure in the well. A difference between a measure of steam injection and a measure of steam production may be monitored, and the steam pressure may be reduced when the difference is higher than a pre-selected threshold. The measure may be a rate, or a volume. Temperatures at a plurality of locations in the well may be monitored, and in b) and c) steam may be circulated through the well at a sufficiently high circulation rate such that the temperatures are substantially uniform. Steam may be circulated through the well at a circulation rate of more than 50 ton/day in b) and c). Prior to b), steam may be circulated within the well at a circulation rate and steam pressure sufficient to heat the region of oil sands by heat conduction. Prior to b), the circulation rate may be increased to a sufficient level to establish a substantially uniform temperature distribution along a length of the well. The steam pressure in c) may be selected to maintain a conservation of steam circulated through the well. The dilation pressure may be a formation breakdown pressure higher than the minimum in situ stress in the region. In b) the bottom-hole pressure in the well may be increased at a rate of 10 to 1000 kPa/h. In b), the bottom-hole pressure in the well may be incremented in steps, and after each increment, the bottom-hole pressure may be maintained substantially constant for a pre-selected period before the next increment. Each increment may be about 500 kPa or less. The pre-selected period may be about 30 minutes or longer, such as about one hour. Each increment may be from 5 to 500 kPa. The wells in the well pair may each have a section that extends substantially in a horizontal direction, wherein the substantially horizontal sections of the wells may be substantially parallel and fluid communication may be established between the substantially horizontal sections. The substantially horizontal sections of the wells may be vertically spaced apart. The distance between the substantially horizontal sections of the wells may be about 3 meters or greater, such as about 3 to about 6 meters, and may be up to the full reservoir thickness. The well pair may comprise an injection well and a production well, completed for a steam-assisted gravity drainage (SAGD) process. Steam may be circulated in each well of the well pair. In c), bottom-hole pressures in the wells of the well pair may be controlled such that the bottom-hole pressure in a first well of the well pair is higher than the bottom-hole pressure in a second well of the well pair, and the pressure difference between the bottom-hole pressures is sufficient to drive a fluid from the first well to the second well when fluid communication is established between the well pair. The rates of steam injection and steam production of the first and second wells may be monitored to provide the signal indicative of fluid communication between the well pair. The bottom-hole pressure in at least one of the first and second wells may be monitored to provide the signal indicative of fluid communication between the wells. After a signal indicative of fluid communication between sections of the well pair has been detected, circulation of steam in each well of the well pair may continue and steam pressures in the wells may be maintained at the level sufficient to enlarge the dilated region between the wells, so as to lengthen the sections of the wells between which there is fluid communication. Xylene may be injected into the region between the well pair.

In accordance with another aspect of the present invention, there is provided a method of establishing fluid communication between a well pair in an oil-sand reservoir, the reservoir comprising dilatable oil sands forming a barrier to fluid communication between the well pair. The method comprises circulating water or steam within a well of the well pair to apply a water or steam pressure to a region of the oil sands adjacent to the well, wherein the circulating water or steam within the well comprises injecting water or steam into the well and producing water or steam from the same well; increasing the water or steam pressure to a dilation pressure sufficient to dilate the oil sands in the region; and while circulating water or steam within the well at a substantially steady state, maintaining the water or steam pressure at a level sufficient to enlarge the dilated region, until detection of a signal indicative of fluid communication between the well pair. In selected embodiments, the water or steam may be water. In some embodiments, the water or steam in b) may be water, and the water or steam in c) may comprise steam. Water may be heated before it is injected into the well. The water being injected into the well may be at a temperature from about 0 to about 320° C., such as about 50 to about 100° C.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures, which illustrate, by way of example only, embodiments of the present invention.

DETAILED DESCRIPTION

Figure 1:
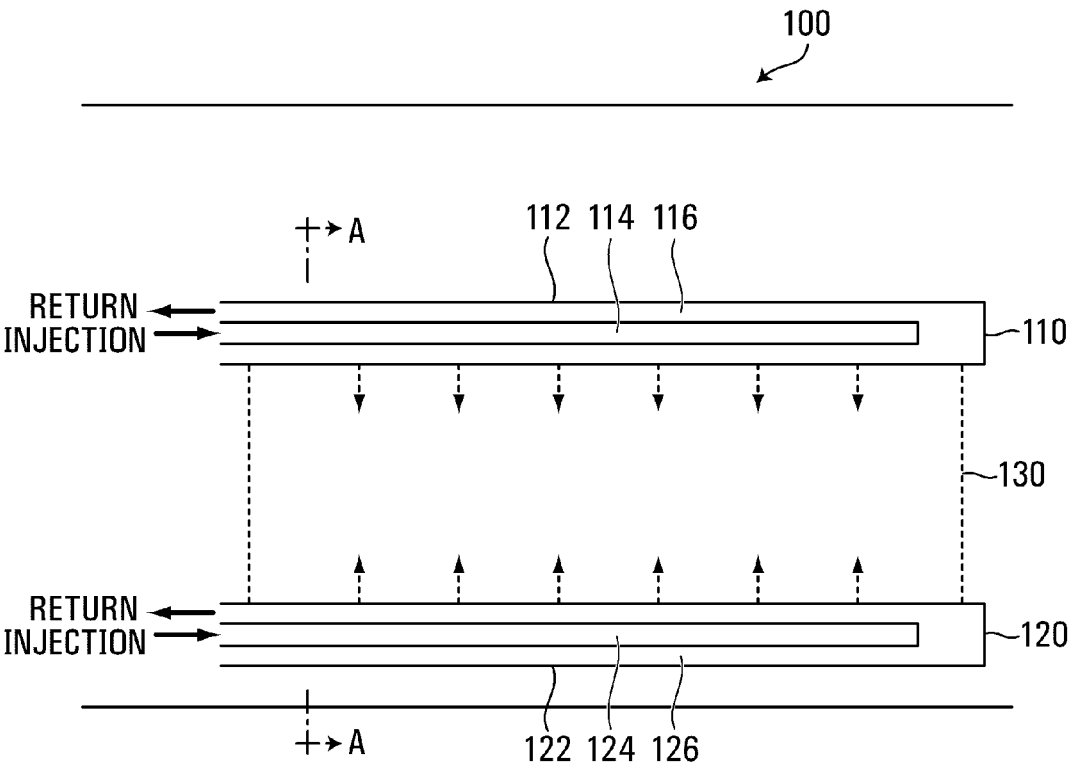
FIG. 1 is a schematic side plan view of a well pair in a formation of oil sands, where fluid communication between the well pair is to be established according to an exemplary embodiment of the present invention.

In overview, an aspect of the invention involves the recognition that in certain reservoirs or formations of oil sands, such as McMurray formations, the oil sands are unconsolidated or un-cemented and can be dilated, i.e., expanded in volume with an attendant increase of porosity. Dilating the inter-well region can facilitate fluid communication between a well pair in the oil sands, particularly if the inter-well region is dilated along a substantial length of the well pair. It has also been discovered that the inter-well region can be conveniently and effectively dilated by circulating steam or water in one or both of the wells at bottom-hole pressures above the effective minimum in situ stress in the formation, even beyond the expected fracture pressure in some embodiments, to establish fluid communication over a substantial length of the well pair.

Conveniently, the time required to establish fluid communication between the wells by such a dilation process can be significantly less than, for example, the time required by conduction heating with steam circulation at low pressures. Fluid communication can also be conveniently established along a longer length of the well pair, as compared to, for example, fracturing by injection of a high pressure fluid at high rates. Further, when the wells are later operated to recover oil from the oil sands, such as in a steam-assisted gravity drainage (SAGD) process, the time required for reaching peak oil production may be reduced, and the cumulative steam-to-oil ratio (CSOR) may be lowered.

Dilation, or the expansion in volume, of oil sands, can result from rearrangement of the unconsolidated or un-cemented oil sands due to rotation or translation movement caused by an applied pressure. Without being limited to any particular theory, dilation can result from shear or microcracking. In shear dilation, sand grains in different shear planes can rotate or shift during shearing, which typically increases the porosity as the porosity in undisturbed oil sands is typically minimized under the ambient formation stress. Small openings (microcracks) can be produced when sand grains are pushed apart by a fluid pressure which also leads to increased porosity. It is expected that dilation is unlikely to occur in rocks, or in formations of consolidated or cemented sands as rearrangement of the grains is required for dilation.

It should be noted that dilation is different from fracture. Fracture in a formation refers to the break, crack, or the creation of a narrow, long open channel, in a rock or a formation of consolidated/cemented oil sands, under an applied pressure higher than the formation fracture pressure. A single fracture (or open channel) can propagate for a substantial distance, such as more than 10 meters, when the applied pressure is maintained above the fracture pressure, or above the fracture extension pressure after initial fracture, typically by injecting fluids at high rates for extended periods of time. The fracture pressure for a given reservoir may be difficult to accurately predict, and it has been reported that even for different well pads within the same oil sand formation, the fracture pressures varied significantly.

The fracture extension pressure for a given formation is typically considered the upper bound for the minimum horizontal stress or closure pressure in the formation, and may be measured by a technique known as a "mini-frac test." In a typical mini-frac test, water is injected intermittently into a perforated vertical well at varying rates and the pressure response during periods of water injection and shut-in are monitored. Interpretation of the measured pressure response can give the fracture closure pressure which is generally considered to be equal to the minimum in-situ stress.

Typically, fracture openings are long and narrow. Thus, as compared to a dilated region of oil sands, a fractured region typically has a much higher permeability but significantly lower porosity. For a fractured region, the permeability typically increases by orders of magnitude for a relative small increase in the porosity, whereas for a dilated region the permeability and the porosity both increase to a similar degree, generally by less than about fifty percent. In comparison, increased fluid mobility in a dilated region is mostly due to a mobile fluid filling the extra pore space created by dilation rather than by an increase in the permeability of the rock as is the case for a fracture.

It has been recognized that when a formation is fractured, injected steam tends to move preferentially through the fracture. As a result, the volume heated by the steam is limited to the regions along the fracture. Further extension of fluid communication along the length of the wells would consequently become difficult. Thus, while fracturing the inter-well region between a well pair by applying a sustained high pressure above the fracture pressure could quickly establish fluid communication between the well pair, it would take longer to obtain peak production of oil, as compared to a start-up procedure without fracture such as the process described in Edmunds. Further, fracture extension is difficult to control and can extend to thief zones, which are zones of high permeability and capable of absorbing a large amount of injected fluids. In some cases, when the inter-well region is fractured, it may no longer be practical or economical to further develop the formation to obtain full production of oil, and the well pair may have to be abandoned. Thus, substantial fracture between the wells, particularly any fracture that extends between the wells or extends to a thief zone, should be avoided according to at least selected embodiments of the present invention. It should be understood that limited fractures which do not lead to direct fluid communication between the wells or from wells to thief zones may be tolerated, and may be inevitable in some oil sand reservoirs.

Figure 2:
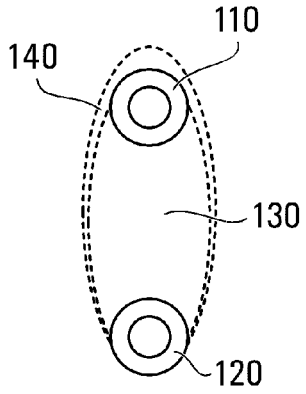
FIG. 2 is a schematic section view of the well pair of FIG. 1 and a dilated region adjacent to the well pair, along the line A-A.

An exemplary embodiment of the present invention relates to a method of establishing fluid communication between a pair of wells 110, 120 in a hydrocarbon reservoir formation 100, as illustrated in FIGS. 1 and 2.

As depicted in FIGS. 1 and 2, wells 110, 120 may have sections 112 and 122 that are substantially parallel and co-extensive in some embodiments. Each well 110, 120 may include an injection conduit 114, 124 for injecting a fluid to the far (toe) end of well 110, 120 and a return conduit 116, 126 for producing the returned fluid. Wells 110, 120 are completed with perforated liners such that the pressure in wells 110, 120 can be transmitted to the surrounding formation and fluids (such as steam) in wells 110, 120 are allowed to flow into formation 100. The liner for the lower well 120 also allows a fluid (such as condensed water) to flow from formation 100 into well 120.

In a startup operation, according to an exemplary embodiment, steam is injected into each well 110, 120 through injection conduit 114, 124 and produced through return conduit 116, 126, respectively, as illustrated in FIG. 1. That is, steam is circulated in each well 110, 120. The injection pressure and rates of injection and production are regulated and adjusted to control the steam pressure applied to the inter-well region 130. For example, the injection pressures and net injection rates (net injection rate=rate of steam injection−rate of steam production) may be monitored and adjusted to control the bottom-hole pressure (BHP) in each well 110, 120.

In selected embodiments, steam is initially circulated in at least one of wells 110, 120 at a BHP below the formation breakdown pressure for a period of time (typically up to a few weeks) to heat the inter-well region 130 in formation 100. During this initial circulation period the steam circulation rates are controlled (by producing almost all of the injected steam from the same well) to maintain the pressure below the formation breakdown pressure, in order to promote uniform distribution of pressure, temperature and steam quality along the length of the wells 110, 120. When enough heating has been achieved (such as after a pre-determined period of circulation) the steam production rate is reduced to increase the BHP in order to gradually dilate and then enlarge the dilated region (schematically illustrated in FIG. 2 as region 140) and establish fluid communication between sections 112 and 122.

It should be noted that circulating steam in a well is different from simply injecting steam into a well. Circulating steam in a well requires injection of steam into the well and production of a sufficient portion of the injected steam from the same well to maintain the desired BHP in the well. By comparison, in simple steam injection, no or little injected steam is produced (returned) from the same well, although the injected steam may be produced from the other well in the well pair. As a result, a much higher steam injection rate can be achieved by circulating steam in the well, as compared to simply injecting steam into the well. Field test results show that circulating steam in a well at a sufficient high injection rate can promote uniform distribution of pressure, temperature and steam quality along the length of the well.

For example, in selected embodiments, the rate of steam injection may be maintained at up to 200 tons/day during initial circulation and at even higher rates during dilation.

Figure 3:
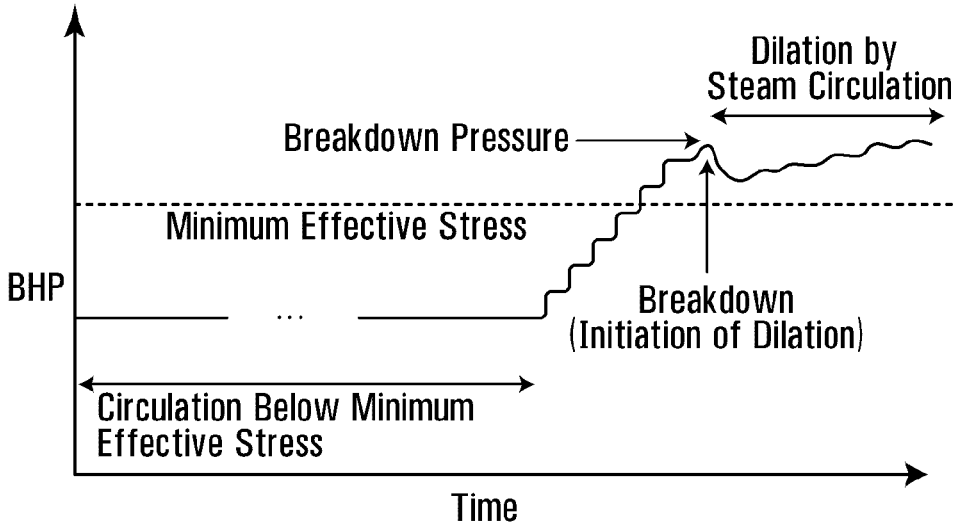
FIG. 3 is a line graph illustrating a profile for bottom-hole pressure (BHP) increase to establish fluid communication between the well pair of FIG. 1, according to an exemplary embodiment of the present invention.

The steam injection and production rates and the BHP in each well 110, 120 are monitored, and the steam injection and production rates are controlled to regulate the BHP so that the BHP is adjusted as desired, such as illustrated in FIG. 3.

As can be appreciated, the BHP in each well is expected to closely reflect the steam pressure applied to the region of oil sands adjacent to the corresponding well. Thus, the steam pressure applied to the adjacent region of oil sands can be controlled by controlling BHP, and can be roughly represented by the BHP. BHP may be measured directly with a pressure sensor located downhole, or may be calculated based on wellhead pressure and the estimated pressure gradient in the well. The latter technique is a common technique in oil recovery operations and can be readily performed by those skilled in the art.

As illustrated in FIG. 3, after the initial period of steam circulation at below the breakdown pressure, while steam circulation continues in the well, the BHP may be increased slowly in stepped increments until a breakdown pressure is reached. The breakdown pressure is reached when dilation occurs in a region of the formation adjacent to the well such that steam is absorbed into the dilated region. Formation breakdown can be detected by a drop in BHP during steady state circulation, or by a reduction in the produced steam from the same well. The breakdown pressure for a particular formation may be estimated based on prior testing, or calculation. As can be understood, formation breakdown can also occur when the formation is fractured.

As will be further explained below, it has been discovered that slowly ramping up BHP with relatively high steam circulation rate allows the thermal energy to distribute along the length of the wells more uniformly, and allows better control of the applied steam pressure to avoid fracture or localized dilation. As depicted, the BHP may be increased in small increments (steps), and the increment may be reduced as the BHP exceeds the minimum in situ stress in the formation and approaches the expected value for the breakdown pressure.

For example, the increment/step may be initially about 500 kPa, and be subsequently reduced to smaller increments of about 50 kPa, or less. The increment may be as low as about 5 kPa in some embodiments. The increase of BHP may be effected by an increase in the injection rate, or a reduction in the steam return (production) rate.

After each increment, the BHP may be held at the same level for a pre-selected time period, such as about 30 minutes or an hour, before being further increased. This allows time to respond if dilation is detected, or communication between wells is detected, the benefits of which will become apparent below.

In alternative embodiments, the BHP may also be continuously increased at a rate sufficiently slow to achieve the same effects or benefits as the stepped increment. For example, the BHP may be continuously increased at a rate of from about 100 to about 1000 kPa/h.

As the BHP (and hence the steam pressure applied to the region to be dilated) is increased to a pressure sufficient to initiate dilation of the oil sands in the region (the dilation pressure), a signal indicative of dilation in the oil sands is monitored. The detection of breakdown may indicate that dilation has occurred. Thus, the signal may be provided by monitoring a substantial drop in BHP or increased loss of injected fluid when the injection pressure and injection rate are held constant or at a substantially stable level. Such a drop in BHP or increased fluid loss (or both) indicates that the porosity of the region of oil sands has increased and the newly opened pores have been filled with steam/water injected from the well.

When the last increase in BHP does not result in observable dilation after a pre-selected period, or breakdown, the BHP can be further increased.

When dilation occurs, as a response to the initiation of dilation, the BHP may decrease (signalling that the breakdown pressure has been reached). At this time, steam continues to be injected at a substantially steady rate at the reduced BHP and the steam return rate is monitored. This will allow the operator to observe if dilation has occurred. By limiting the steam injection rate, the operator can conveniently minimize the potential for fracturing the formation. Steam circulation then continues at a chosen steam injection rate while the steam return rate is gradually reduced to gradually increase the BHP and further enlarge the dilated region. This procedure thus allows controlled expansion of the dilated region while minimizing the potential for propagating a fracture over a significant distance. At this stage, BHP may be increased in stepped increments, as illustrated in FIG. 3, or continuously at a selected rate, to approach the breakdown pressure, while the steam injection rate (and return rate) may be maintained at a sufficiently high level to promote uniform distribution of pressure, temperature and steam quality within the well.

As discussed above, the BHP may be controlled by adjusting the steam flow rates (i.e., the injection and return rates). For example, it may be decreased by increasing the return flow rate (steam/water production rate) while maintaining the injection rate at a constant level. While the steam injection rate may also be decreased to decrease the BHP in some embodiments, it may be more convenient to adjust the BHP by adjusting the return flow rate, while maintaining the injection rate at a substantially constant level. Similarly, the BHP in a well may be increased by increasing the injection rate, or by decreasing the production rate for the well.

Prior to dilation, or after dilation but before communication between the wells, steam may be circulated in both wells 110, 120 at pressures below the minimum in situ stress to heat the inter-well region by conduction for an extended period of time. This can conveniently soften the bitumen in the oil sands allowing pressure transmission further from the well, and may also facilitate dilation by altering the in-situ stresses in the formation. For example, and without being limited to any particular theory, it can be expected that when the bitumen in the oil sands is softened, it may require less shear pressure to move the sand grains. In addition, steam circulation in a well can heat up the formation around the well. At a higher formation temperature, condensation of injected steam due to heat losses prior to the steam reaching the formation is reduced. With reduced steam condensation in the well, a more even distribution of temperature, pressure and steam quality along the length of the well may be achieved in the well prior to dilation, which is believed to promote a longer and more uniform dilated region.

The steam dilation process may be continued, with or without intermittent steam circulation at lower pressures for conduction heating, until fluid communication is established between wells 110, 120. To detect fluid communication between wells 110, 120, a signal indicative of fluid communication can be monitored. To provide such a signal, the BHP in one of the wells, such as well 110, may be maintained to be substantially lower than the BHP in the other well, such as well 120. The pressure difference in BHP may be about 200 kPa. In a different embodiment, the pressure difference in BHP may be up to about 500 kPa. When fluid communication has been established between wells 110, 120, the pressure difference can drive a net fluid flow from the higher pressured well (e.g. well 120) to the lower pressured well (e.g. well 110). Thus, an increase in fluid production at the lower pressured well, coupled with a corresponding reduction in fluid production at the higher pressured well, will provide an indication that fluid communication has been established between the wells. Further, when other circulation conditions are unchanged, the pressure difference between the wells will decrease, and the pressure in one well will track the pressure in the other well, due to fluid communication between the wells, which can thus also provide an indication that fluid communication has been established.

In selected embodiments, uniform steam saturation along both of the wells may be maintained during dilation. Uniform steam saturation can be conveniently achieved with steam circulation in each well, but could be difficult to achieve without steam circulation.

After fluid communication between wells 110, 120 has been established, dilation may be terminated and the BHP may be decreased. However, sometimes fluid communication may be initially established between only short sections of wells 110, 120. The extent of fluid communication along the length of the parallel sections of wells 110, 120 can be determined by monitoring temperatures at different locations along the wells, as explained elsewhere herein. In case fluid communication is initially limited to a small section of the wellbore length, dilation may be attempted again after circulation of steam at a steady state below the dilation pressure, to enlarge the dilated region along the length of the wells. That is, after a signal indicative of fluid communication between sections of the well pair has been detected, circulation of steam in each well can be continued, with the steam pressures in the wells being maintained at a level sufficient to enlarge the dilated region between the wells, so as to lengthen the sections of the wells between which there is fluid communication. Dilation may be terminated after fluid communication has been established along a sufficient length of the wells, such as the full length of the horizontal sections of the wells in a SAGD process.

After fluid communication has been achieved steam returns from one of the wells may be terminated so that steam is forced to flow through the dilated zone to heat up the formation prior to transitioning to oil production such as SAGD operations. Steam production is continued in the other well but steam injection in the other well may continue or may be terminated. The dilated zone may be heated in this manner for a period of time, such as a few weeks, to ensure that sufficient thermal energy has been transferred to the dilated zone to mobilize the heavy oil or bitumen in the dilated zone so that the oil can flow through the zone with water.

As can be understood by those skilled in the art, after communication between the wells is initially established, communication through the dilated zone can potentially decline or even stop, if mobile oil displaces mobile water in the pores of the formation and subsequently become very viscous again, such as due to cooling. If this occurs, steam circulation can be resumed with a BHP at a level sufficient to cause further dilation.

Formation 100 should contain recoverable viscous hydrocarbons or petroleum, which may be in a form referred to as heavy oil, heavy hydrocarbon, or bitumen. It can now be appreciated that formation 100 may be any suitable oil-sand formation in which the oil sands are dilatable. Oil sands are alternatively referred to in the literature as tar sands, or bituminous sands.

Dilatable oil sands are substantially unconsolidated and un-cemented, or only weakly cemented such that a substantial portion of the sand grains can move relative to each other under an applied force resulting in substantial expansion in volume. Thus, when a sufficiently high fluid pressure, with or without heat, is applied to a volume of the oil sands, the volume of the oil sands can substantially expand due to increase in porosity.

The dilation pressure (the fluid pressure required to initiate dilation in oil sands) can vary depending on many different factors and may be different for different oil sand reserves. While the dilation pressure can be estimated, it may be difficult to accurately predict the precise dilation pressure for any given region of oil sand formation. In theory, however, the dilation pressure should be high enough to overcome the minimum in situ stress in the particular reservoir formation, as can be understood by those skilled in the art. The minimum in situ stress can be measured with a standard mini-frac test conducted in any nearby vertical well and this measured stress can be used to estimate the minimum stress at the depth of the wells to be dilated.

Conveniently, it is not necessary to know the dilation pressure before commencing the dilation procedure in practice. In selected embodiments, the BHP may be increased slowly, particularly after it has been raised to above the minimum in situ stress, until dilation is observed. To avoid undesirable fracturing or localized dilation, the BHP may be reduced in response to detection of a signal indicating that dilation has occurred in the inter-well region. Further dilation may be carried out at a BHP high enough to enlarge the dilated region but at low enough net injection rates to avoid substantial fracturing. Practically, if the steam circulation can be maintained at a substantially steady state, it indicates that there is no substantial fracturing as when the formation is fractured, a substantial amount of steam or water will be lost. When injected steam is lost into the formation, the net injection rate will increase or the net production rate will decrease. However, the total rate of steam loss into the formation should not be allowed to exceed the steam injection rate, and should be maintained at a low enough rate to minimize the risk of fracturing. As can be understood, the rate change would be more pronounced after fracturing than after dilation. After dilation in a local region, steam loss is limited in volume and in time, as only the newly expanded pores can accept water and once the expanded pores are saturated with water, there will be no further loss of steam or water from the well(s). After fracturing, in comparison, water or steam loss can be much faster and higher in volume, as water or steam can travel quickly through the fracture over a long distance. Further, as the fracture may lead to a region (such as a thief zone) that can receive a large amount of water, water or steam loss can extend over a long period of time.

Thus, the changes in net injection rate or net production rate can be used to indicate occurrence of fracture and dilation and with steam circulation these rates are easily measured and controlled. In selected embodiments, the rates of steam injection and steam production in each well are monitored during the dilation procedure and are controlled to adjust the BHP as desired.

For example, to promote uniform dilation along the length of the wells, and to avoid fracturing, the BHP may be decreased when it is detected that the rate of loss of water or steam into the formation is high, the BHP may be maintained at a pressure that some loss of water or steam occur over time but the rate of loss or the amount of loss is limited to below a pre-selected threshold. The BHP can thus also be controlled to slow down the dilation process so that the dilated region will not expand too quickly within a narrow area, and allow dilation to occur over a wide area between the wells. The suitable thresholds for the net rates will depend on the particular conditions of the reservoir formation, the configuration of the wells, and the available steam handling capacities, and can be determined by those skilled in the art based on these factors and other conditions in a particular case, potentially by numerical simulation.

The formation parameters discussed herein, such as porosity, permeability, in situ stress, breakdown or fracturing pressure, can be measured using techniques discussed herein, or other techniques known to those skilled in the art. For example, reservoir formation porosity and permeability may be determined from core measurements and well logs. The minimum in situ stress may be determined based on mini-frac tests.

In some embodiments, wells 110 and 120 may each have a section 112, 122 extending along a substantially horizontal direction into formation 100, as depicted in FIGS. 1 and 2. As depicted, sections 112, 122 may be substantially parallel to one another, and may be vertically spaced apart with one above another. The upper well 110 may be completed as an injection well, and the lower well 120 may be completed as a production well.

In selected embodiments, wells 110, 112 may be completed as an injector-producer well pair for a steam-assisted gravity drainage (SAGD) process.

As can be understood, when a pressure differential is maintained between wells 110, 120, the BHP in either well 110 or 120 may be higher. However, as the in situ stress is typically expected to be higher for a lower region in the formation than in a higher region in the formation, in some embodiments where the wells are vertically spaced one above the other, it is more efficient to have the BHP in the lower well (e.g. the production well in the SAGD process) higher than the BHP in the upper well (e.g. the injection well in the SAGD process).

Figure 4:
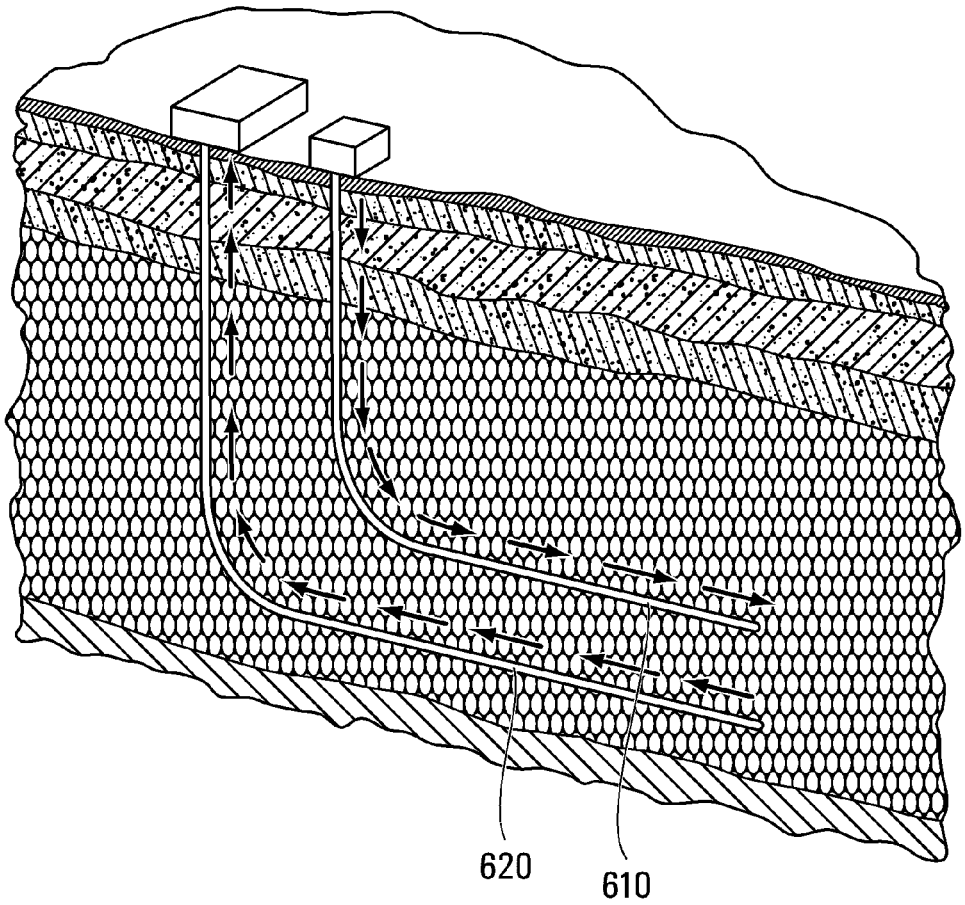
FIG. 4 is a perspective view of a well pair configuration for a SAGD process.

An exemplary arrangement of a pair of injection and production wells 610, 620 for a SAGD process is schematically illustrated in FIG. 4. As depicted, both wells 610, 620 are drilled into the oil sand formation, with the horizontal sections of wells 610, 620 near the bottom portion of the reservoir formation. As depicted, during normal SAGD oil production, steam is injected into injection well 610 and fluids (water and oil) are produced from production well 620. However, for dilation start-up according to an embodiment of the present invention, both wells 610, 620 may be completed for steam circulation. The horizontal sections of wells 610, 620 may each have a length from about 500 m to about 1500 m, such as about 800 m. The distance between the horizontal sections may be from about 3 to about 8 m, such as about 4 to about 6 m. In some embodiments, the distance may be about 5 m. In selected embodiments, the distance may be greater than 3 m and as much as the full thickness of the reservoir.

Figure 5:
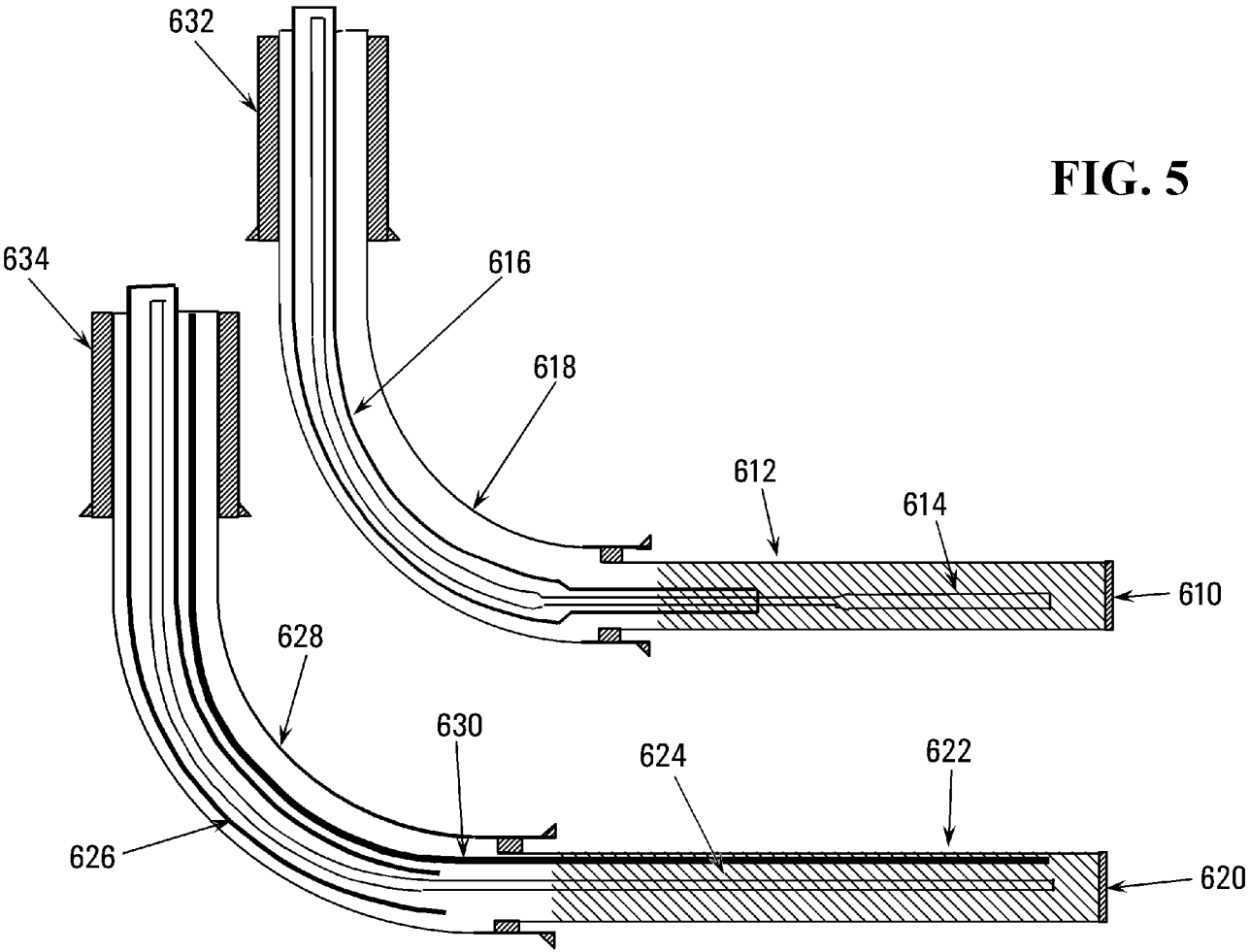
FIG. 5 is a side plan view of an exemplary embodiment of a well pair for a SAGD process.

An exemplary well pair configuration for wells 610, 620 is illustrated in FIG. 5. As depicted, each well 610, 620 is provided with a slotted liner 612, 622, an inner tubing string 614, 624, an outer tubing string 616, 626, and a casing 618, 628. Inner and outer tubing strings 614, 616 or 624, 626 may be concentric. Outer tubing strings 616, 626 have a larger diameter, such as about 4½ to about 5½ inches, and terminate at, or near, the heel of the well pair. Inner tubing strings 614, 624 have a smaller diameter, such as about 2⅜ to about 2⅞ inches, and extend to the toes of the well pair. An instrument string 630 may be provided in one or both of wells 610, 620, such as in well 620 as depicted in FIG. 5. Thermocouple sensors for measuring temperature (not separately shown) may be supported on instrument string 630 at different locations. The temperature sensors may be provided at selected locations for monitoring purposes, as can be understood by those skilled in the art from this disclosure. In one embodiment, 6 thermocouples may be evenly distributed from heel to toe within well 620. A surface casing 632, 634 may be provided for isolating shallow ground water from any injected fluid or returned fluid from each well 610, 620. A pressure transmitter (not shown) may be provided to measure a surface case pressure, as can be understood by those skilled in the art.

In use, steam may be injected through inner tubing strings 614, 624 to the toes of the well pair. During steam circulation, the injected steam turns around at the toe and flows back through the well bore space between inner tubing string 614, 624 and the liner 612, 622 and then returns to surface through the space between casing 618, 628 and outer tubing string 616, 626. Some steam may flow into the adjacent oil sands through slotted liner 612, 622. The downhole pressures, or BHP, may be controlled by varying the steam injection rates through inner tubing strings 614, 624 and the steam return rates at casings 618, 628.

In a selected embodiment, a non-condensable gas, such as methane or nitrogen, may be fed ("bubbled") into outer tubing string 616, 626 to form a static column of gas. This column of gas can be used to estimate the BHP by measuring the pressure on the surface (at the surface end of casing 618, 628) and the hydrostatic head pressure of the gas column, and adding the two pressures to obtain the BHP.

Steam may also be injected through both inner and outer tubing strings 614, 616 of injection well 610, such as during normal SAGD oil production operation.

It should be understood that in different embodiments, wells 610, 620 may be arranged and configured differently.

Drilling and completion of wells 110 and 120 or 610 and 620 for SAGD, or another in situ thermal recovery process, can be readily performed by those skilled in the art. However, some modifications to known techniques or well completion may be necessary or helpful for the purpose of the present embodiment, as discussed herein.

For example, fluid control valves or flow regulators (not shown) may be provided at appropriate locations to control the flow rate of steam into and out of wells 610 and 620. Flow rate meters such as gauges (not shown) may be provided for measuring the fluid flow rates through inner tubing 614, 624 and outer tubing 616,626.

Figure 6:
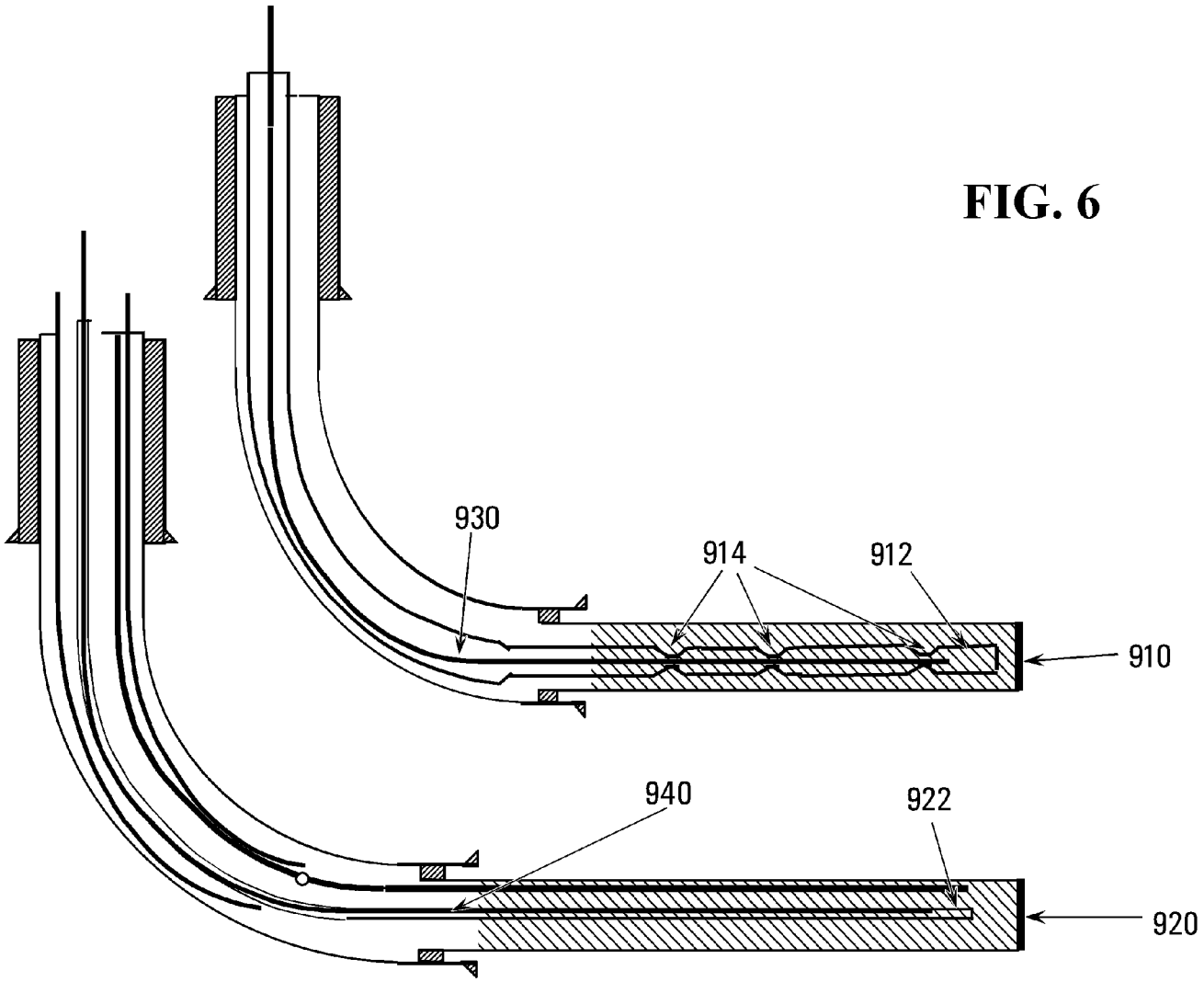
FIG. 6 is a side plan view of another exemplary embodiment of a well pair for a SAGD process.

FIG. 6 illustrates a further exemplary configuration of a well pair for a SAGD process, which includes an injector 910 and a producer 920. To improve uniform thermal energy distribution in the wells, and thus in the inter-well region, multiple steam injecting points may be provided on the injection tubing, as illustrated by injection tubing 912 in FIG. 6. Multiple steam ports 914 are provided on injection tubing 912 to provide steam release points and an additional smaller tubing 930 is provided inside tubing 912 to allow for steam circulation to the end of the well 910. To improve the production capacity of producer 920, a larger tubing 922 may be provided as illustrated by production tubing 922 in FIG. 6. An additional smaller tubing 940 may be provided inside tubing 922 to allow for steam circulation to the end of the well 920.

In a different embodiment, a tubing with multiple steam ports may be provided in producer 920, to replace tubing 922.

In selected embodiments, an exemplary dilation procedure may be carried out as detailed below, with well 620 or 920 being used as the production well (producer) and well 610 or 910 being used as the injection well (injector). The injection flow rate may be monitored using steam flow transmitters (not shown) normally used in SAGD process. Surface wellhead injection pressure may be monitored using pressure transmitters (not shown) used for normal SAGD operation. Similarly, the production (return) rate of steam, and potentially steam condensate, in the production well may be controlled with a production control valve as in normal SAGD operation.

In operation, steam circulation may be started in each well, such as well 610, by first opening the return (production) valve (not shown), and steam may then be injected by opening the injection valve (not shown). Steam will flow from heel to toe in inner tubing 614, and flow back from the toe through the casing, such as casing 612.

As discussed above, prior to dilation, or between two dilation periods, steam may be circulated in each well, such as well 610, 620, at a BHP below the fracture pressure and a lower circulation rate to heat the inter-well region by heat conduction. During this process, the production rate from the same well is closely monitored to ensure proper circulation.

During the steam dilation process, the BHP may be increased by gradually closing a return valve (not shown) to allow the BHP to build up in the well. The BHP may be calculated using measurements from a hydrostatic head (not shown) at the wellhead on the earth surface and a pressure transmitter (not shown) at surface. In alternative embodiments, an injected gas may be used to measure BHP directly, as can be readily understood by those skilled in the art. In some embodiments, the BHP may be increased to up to 5 MPa at the start of the dilation process.

Temperatures in each well, such as well 620, are measured with temperature sensors, such as sensors (thermocouples) supported on instrument string 630. For example, the thermocouple readings may be monitored to ensure uniform heating and expansion of the inter-well region. The temperatures (or readings on the thermocouples distributed throughout the well length) should be substantially the same for different locations in the well if heat is distributed uniformly along the well length. The variation in temperature at different locations may be reduced by increasing steam circulation rate, and may be controlled to be within about 1 to about 2° C. in some embodiments. In selected embodiments, the steam circulation rates may be sufficiently high so that the measured temperatures at different locations in the well are near the steam injection temperature, such as within about 1 to about 2° C. of the steam injection temperature.

It is noted that it is only necessary to monitor the down hole temperatures in one well in the well pair, because if the other well has similar well characteristics and steam is circulated therein under the same injection/return conditions (BHP pressure and flow rates etc), a similar result of temperature distribution (and thermal expansion) in both wells should be expected. Thus, if the pressures and flow rates are suitable for achieving the desired condition in one well, the other well should have a similar condition when the pressures and flow rates applied in the other well mirrors those applied in the well where temperatures are monitored.

After a uniform temperature distribution has been achieved with steam circulation, the BHP is increased to the dilation pressure (above the minimum in situ stress and the fracturing pressure), such as according to the BHP profile illustrated in FIG. 3.

In different embodiments, the BHP profiles may be different depending on the particular circumstances in a given case, and may be adjusted in response to the operation results or changes in operating conditions.

In one embodiment, steam may be circulated in both wells of the well pair, and the BHP in both wells may be initially increased in the same manner. However, after the BHP has reached about 6 MPa in both wells, the BHP in one well (injector or producer) may be maintained at this pressure and the BHP in the other well may be increased until dilation has occurred.

After dilation has occurred, steam is injected into the injector, and the net injection volume is monitored. The injected steam can further heat the inter-well region and cause removal of bitumen from the dilated inter-well zone. The BHP is decreased in response to detection of a significant increase in net injection volume, until reaching a normal SAGD operating pressure, which is typically below about 5 MPa. For example, communication between the wells can be detected by a temperature response in the production well while steam is injected only in the injector. Communication between the wells may also be detected if the BHPs in the wells are initially different but begin to approach one another (i.e. one falls and the other increases concurrently), as the BHPs will equalize when there is communication.

After dilation is completed, the BHP is gradually reduced to ensure continued communication between the wells and sufficient portions of the bitumen in the dilated region will be mobilized and removed from the dilated zone. If BHP is decreased too quickly, the temperature in the formation may also drop quickly leading to increased viscosity of the oil. As a result, it may become difficult to move the bitumen and fluid communication could be lost. Once the inter-well region is saturated with steam or water, fluid communication between the wells can be more easily maintained throughout the SAGD process.

During the dilation period, the steam injection and production rates or volumes should be monitored closely.

After initial communication is established, the dilated region may be further expanded along the length of the wells. During such expansion period, the monitored injection rate and production rates may be used to detect if substantial fracture has occurred. If the inter-well zone is dilated without significant fracturing, most of the water injected into one well should be produced in the other well, and the net injection volume (or rate) for both wells should be relatively small. If the net injection volume is too high, it indicates that a large amount of water is lost to the formation, which in turn indicates significant fracture. In such a case, water circulation and the dilation procedure should be terminated. For example, if the net injection volume reaches 500 $m^3$, the dilation procedure may be terminated.

As discussed elsewhere, temperatures along the well length may be monitored to determine at which locations communication has been established. For example, when the temperature at a location is significantly higher than the temperatures at other locations, it may indicate that there is communication at that location but there is no or little communication at the other locations.

In some embodiments, the annular space between the vertical wellbore casing portion of casing 618, 628 and inner/outer tubing 614, 624, 616, 626 may be filled with an inert gas, such as nitrogen. The inner gas may conveniently provide certain benefits, as can be understood by those skilled in the art. First, the inner gas can reduce heat loss to the overburden, thus improving thermal efficiency and providing increased casing protection. Second, the inner gas can be utilized to initiate steam-lift production. Third, the inner gas can be utilized to measure (or provide measurements for calculating) the BHP at the surface.

In selected embodiments, steam may be co-injected with a solvent or surfactant to facilitate the mobilization and removal of bitumen from the inter-well region. Suitable surfactant or solvents known to those skilled in the art may be used. For example, xylene may be injected either before, during, after the dilation process. The surfactant or solvent may be selected to have properties that will help to reduce the viscosity of the bitumen in the oil sands.

As noted above, exemplary embodiments of the present invention may be applied to start-up a SAGD process. However, at least some embodiments of the present invention may have application in other thermal aided or steam assisted oil sand recovery processes. While the well pair may include substantially parallel sections, in some embodiments, the well pair may have sections that are at an angle. When there are parallel sections, the parallel sections of the well pair may be horizontal or vertical, although in some embodiments, the dilation process as described herein may be conveniently used when the dilated region is between two parallel and horizontal well sections, as exemplified herein.

The dilation process exemplified herein is not limited to dilating a region between two wells or a single well pair. The procedures described can be applied to dilate regions between any number of wells or well pairs. In different embodiments, the inter-well regions between different wells or well pairs may be sequentially or concurrently dilated.

It should also be understood that, in selected embodiments, it is not necessary that steam circulation be maintained throughout a dilation process. In selected embodiments, steam circulation may be temporarily interrupted or intermittently suspended for various practical reasons. For example, in practice, equipment maintenance or repair may be required from time to time and steam circulation may be suspended for a limited period of time during maintenance or repair work. In selected embodiments, during the interruption steam may be injected but not returned from the same well. It is expected that steam circulation dilation for a sufficient time, even if interrupted, can still dilate the oil sands or expand the dilated region.

As can be further understood, in some embodiments, steam circulation may be replaced with water circulation, particularly warm or hot water circulation. Steam circulation may be replaced with water circulation during only a certain period of the dilation process. For example, the initial dilation may be effected with water circulation at increasingly higher BHP, and the following propagation or expansion of the dilated zone may be effected with steam circulation at sufficiently high BHP. In selected embodiments, the water injected during water circulation may be heated prior to injection. Heated water may provide heat and facilitate uniform temperature distribution along the length of the well. In some embodiments, heated water may be used during water circulation prior to breakdown (dilation). In some embodiments, heated water may also be used during water circulation after breakdown. In some embodiments, heated water may be easier to handle than steam. It may also be less costly to provide heated water than steam. The heated water may have temperatures from about 50 to about 100° C., such as about 80° C. Heated water may be conveniently available at the site for a recovery process such as SAGD process. For example, in a SAGD process, a water tank may be provided for storing water produced from a well. This water tank may be used to provide water for injection during water circulation. In different embodiments, the temperature of the injected water may be outside the range of about 50 to about 100° C. For instance, the injected water may have a temperature between 0 and 50° C., or at a higher temperature, such as up to 310° C. at the injection pressure.

As discussed elsewhere, a desired BHP profile during steam or water circulation may be achieved by adjusting and controlling the injection and production rates of steam or water. It should be understood that in some embodiments, it is not necessary for the injection and production rates to be constantly at the precise levels to achieve a target BHP. For example, a rate may fluctuate around an average level over time and may temporarily deviate from an ideal level without materially affecting the dilation process. Slight and temporary fluctuation or variation of the rates, or even the BHP, from the ideal or target level may be inevitable, and may be tolerable. As an example, during steam circulation within one well, the steam production rate may be temporarily decreased or increased, and may be substantially lower than the steam injection rate at a given time, while still maintaining a generally steady BHP in the well. However, depending on the particular circumstances, fluctuation or variation of the rates and the BHP may need to be within a controlled limit to minimize, for example, risks of unexpected fracture of the formation.

Exemplary embodiments of the present invention are further illustrated with the following examples, which are not intended to be limiting.

EXAMPLES

Example I

Standard Steam Circulation Start-Up (Comparison)

SAGD start-up was conducted with circulation of steam in each of injector and production wells at low injection pressures for three well pairs well on the same oil pad (denoted as B01) of an oil sand reservoir in Alberta, Canada. The three well pairs are denoted as B01-1, B01-2, and B01-3.

The B01 Pad was located in a thick and high reservoir quality region with a McMurray formation. The bitumen (oil sands) interval was overlain by a gas cap (~4 m in thickness) and bottom water at the base. The production wells were at least 5 to 10 meters above the water zone at the base. The bitumen interval (30-35 meters) contained clean cross-bedded sands with an average porosity of about 33% and oil saturation of about 80%.

A standard circulation start-up procedure for SAGD start-up was used. Specifically, the well pairs were configured as illustrated in FIG. 5. Steam was injected into the inner tubing string and returns were produced up the casing in both the producer and the injector well pair. Approximately 200 ton/ day of steam was circulated in each well, with an injector BHP of about 5 MPag and a producer BHP of about 4.8 MPag.

The startup stage of SAGD establishes fluid/thermal communication between the injection and production wells. At initial reservoir conditions, there was negligible fluid mobility due to extremely high oil viscosity (over 1,000,000 centipoises (MPa-s)) and the lack of water saturated zones in the inter-well region. Inter-well communication was established by simultaneously circulating steam through each injector and producer. High temperature steam was flown through a tubing string that extended to the toe of each horizontal well. The steam condensed in the well, releasing heat and resulting in a liquid water phase which then flew back up the casing-tubing annulus by the pressure gradient in the well. Conduction heating was the main heating mechanism during this start-up phase. Start-up steaming operations were maintained until the oil region between the injection well and production well became mobile. The time required to establish fluid communication was well pair dependent and related to injector-to-producer well separation along the horizontal well length, near-wellbore reservoir quality, injected steam temperatures, and the BHP maintained during steam circulation.

The bottom-hole pressure (BHP) in each case was maintained well below the expected fracture pressure, with the maximum BHP in each well being about 5 MPag.

The start-up procedure was terminated when sufficient communication between the well pair was established as indicated by pressure and temperature tracking between the well pair. The average start-up time was about 90 days. The total steam injected during start-up was 20,000 $m^3$.

After communication had been established between the injector and producer over a limited section of the well pair length, steam was continuously injected into the injection well at constant BHP of about 5 MPa. During this period, mobilized oil and water were continuously removed from the production well at a constant temperature, and the zone of communication between the wells was expanded axially along the full well pair length and the steam chamber grew vertically up to the top of the reservoir. The reservoir top had relatively low permeability and prevented the steam chamber from rising further. When the inter-well region over the entire length of the well pair had been heated and the steam chamber had reached the reservoir top, the oil production rate peaked and began to decline while the steam injection rate reached a maximum and levels off. The ramp-up period typically lasted 1 to 2 years, depending on the properties of the particular reservoir formation.

After the ramp-up stage, the steam chamber had essentially achieved full height and lateral growth became the dominant mechanism for recovering oil. As the steam chamber widened, overburden heat losses began to consume an increasing portion of the heat from the injected steam leading to declining oil production rates at steady steam injection rates. Steam was injected into the injection well and controlled to maintain a target steam chamber pressure during this phase. The production well remained submerged in draining oil and steam condensate. The rate of fluid withdrawals from the lower production well was controlled (based on a target production temperature) so that there was fluid above the producer at all times.

To assist the production of fluids from the production well, gas was injected into the production well through the tubing-casing annulus to gas-lift the oil and water. The cumulative steam-to-oil ratio (CSOR) after 3 months of gas lift operation was 10.5.

Example II

Dilation Start-Up at B01-6

Start-up at another well pair (denoted as B01-6) on the B01 pad was conducted with water injection dilation and steam circulation dilation.

The injection and production wells were completed as illustrated in FIG. 5. In this case, the liner 612 of the injection well 610 was slotted. Further, a 6-point thermocouple coil (not shown) was inserted through inner tubing 614. The horizontal sections of the wells were about 800 m long. The vertical stress in the formation was 7.7 MPa.

Figure 7:
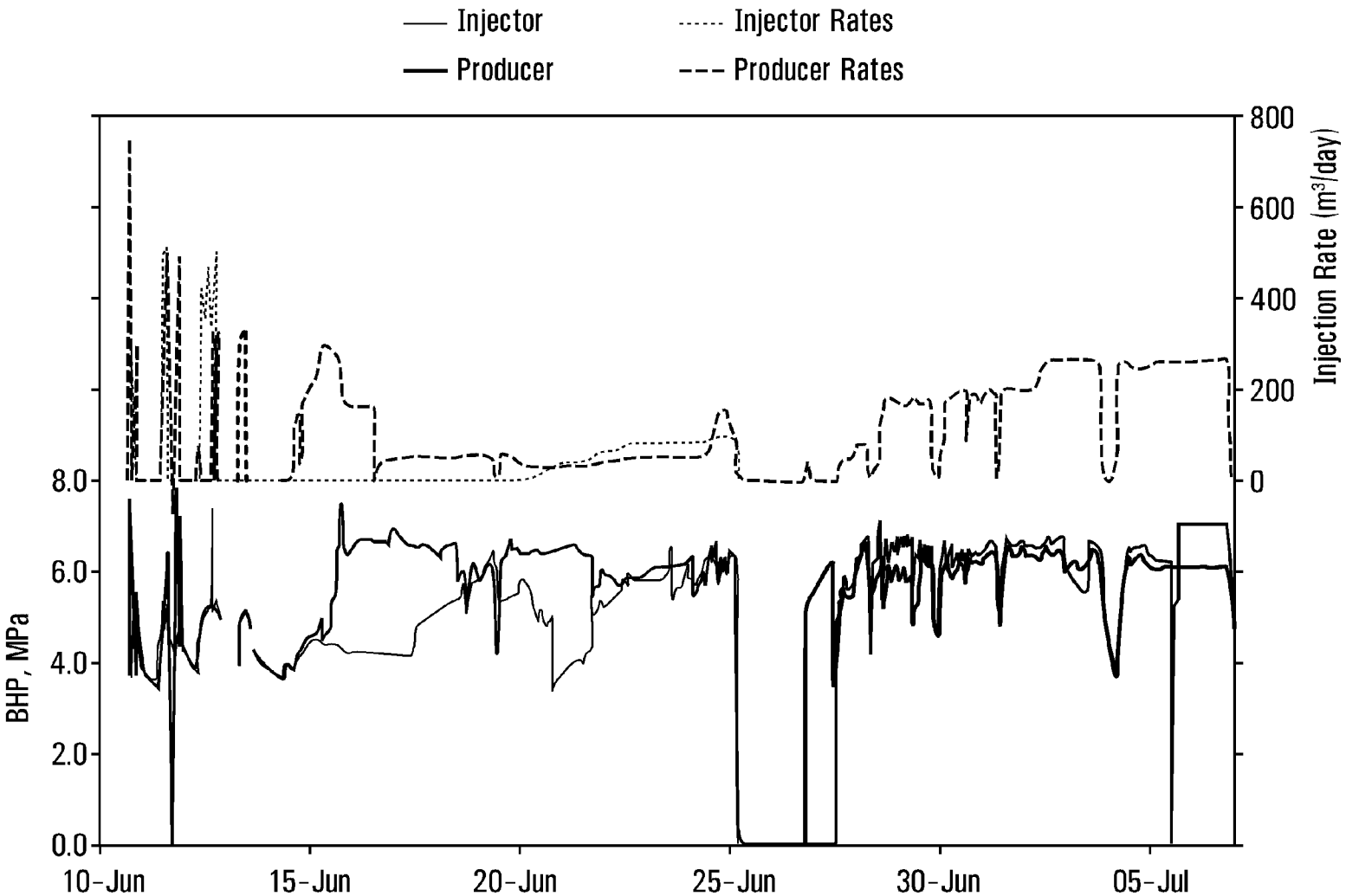
FIGS. 7 and 8 are line graphs showing BHP and injection rate profiles in a dilation start-up process at a first well pair, exemplary of an embodiment of the present invention.
Figure 8:
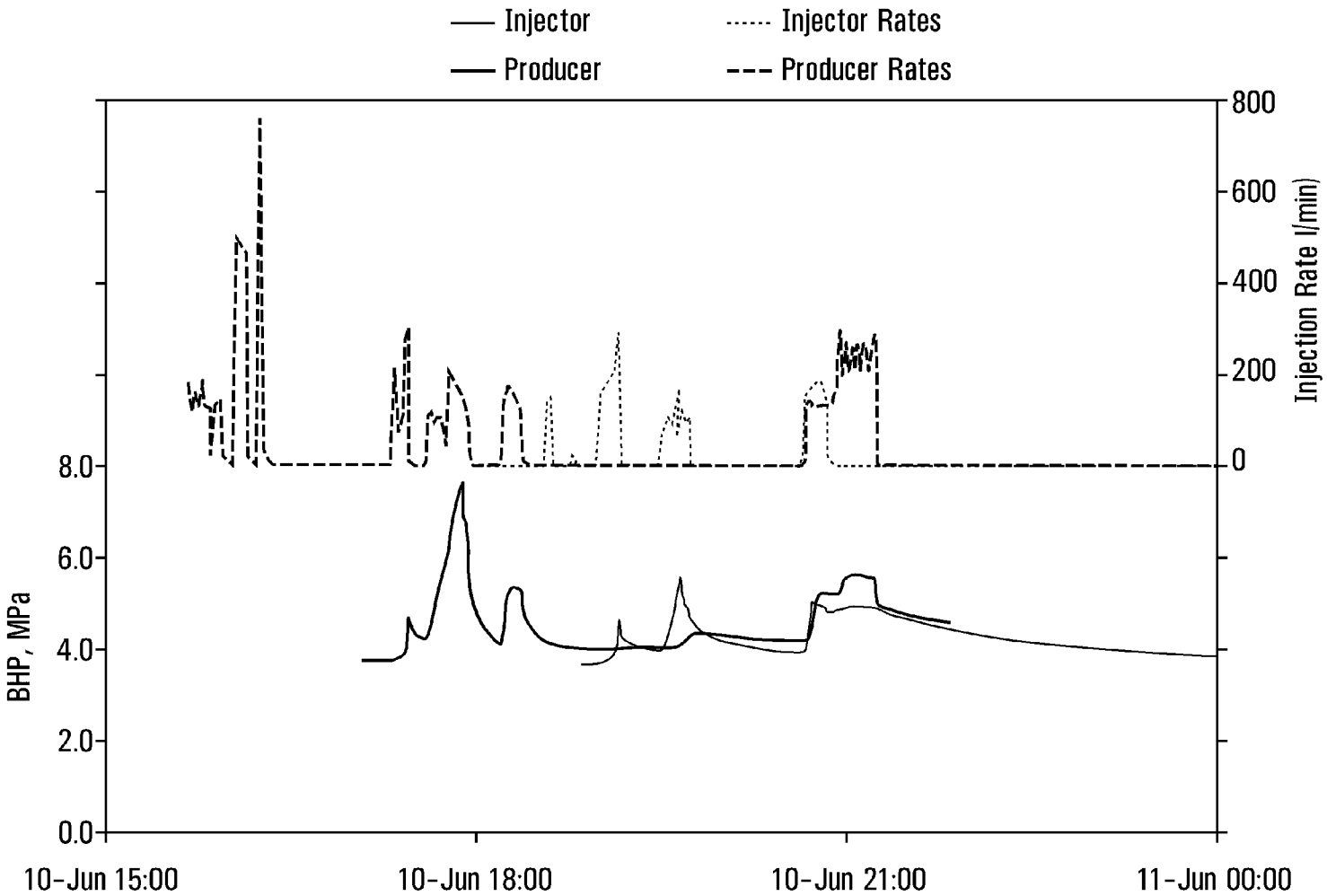
Figure 9:
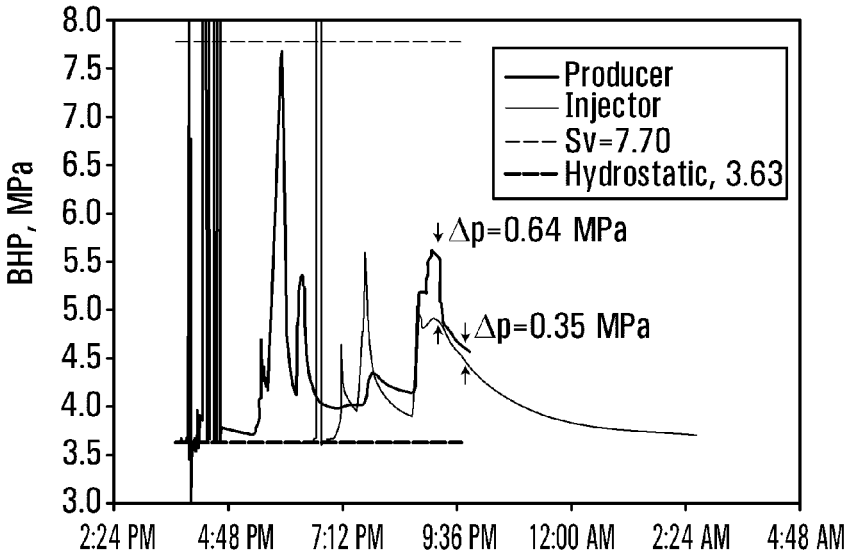
FIG. 9 is a line graph comparing the corresponding changes of BHP in the injector and production wells in the dilation start-up process at the first well pair.

The BHP and injection flow rate profiles during the start-up procedure are shown in FIGS. 7 and 8. The pressure difference between the wells at critical times is shown in FIG. 9. As shown in FIG. 9, the hydrostatic head pressure of the gas column in the well was about 3.63 MPa.

Initially, water was injected into both the injector and producer to dilate the inter-well region for 4 days. The return valves for both wells were closed so the injected water was not produced (i.e. not circulated) during this period. As water pressure was initially increased, formation breakdown occurred at BHP of 7.6 MPa within 18 minutes of water injection as indicated by a sharp drop of the BHP in the producer (see the pressure drop at about 10-June 18:00, FIG. 8). The BHP in the injector dropped sharply after being raised to about 5.6 MPa a few hours later, as can be better seen in FIG. 8, indicating formation breakdown and dilation near injector. As shown in FIGS. 8 and 9, after the breakdown the pressure difference between the wells (ΔBHP) dropped quickly, from about 0.64 MPa to about 0.35 MPa, indicating that fluid communication between the wells had been established about three hours after the initial breakdown. The injector propagation pressure was maintained at 5.6 MPa after the breakdown.

Next, hot water was injected into the producer and produced from the injector. At this time, water was not produced in the producer or injected into the injector. As can be better seen in FIGS. 8 and 9, the BHP of the injector was tracking the BHP of the producer after the breakdown, which also indicated fluid communication between the well pair. Further, as shown in FIG. 9, ΔBHP was maintained at about 0.35 MPa after communication had been established, which indicated that the inter-well region was a dilated zone, because had a fracture extended between the wells through the inter-well zone, the pressure differences would have been much smaller.

Figure 10:
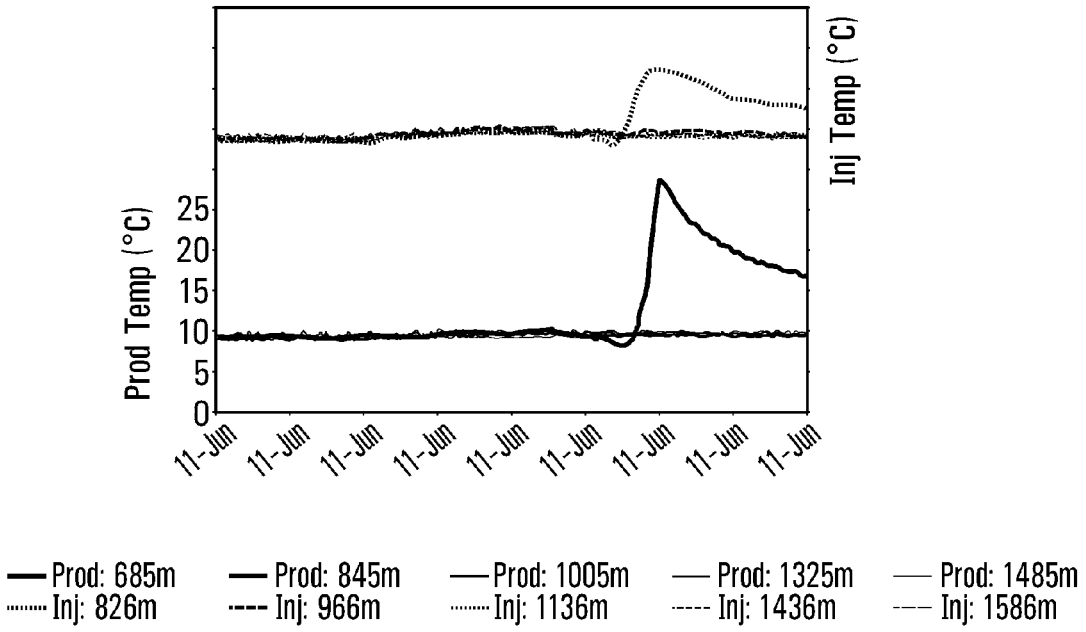
FIG. 10 is a data graph showing the temperature distribution in the wells during the dilation start-up process at the first well pair.
Figure 11:
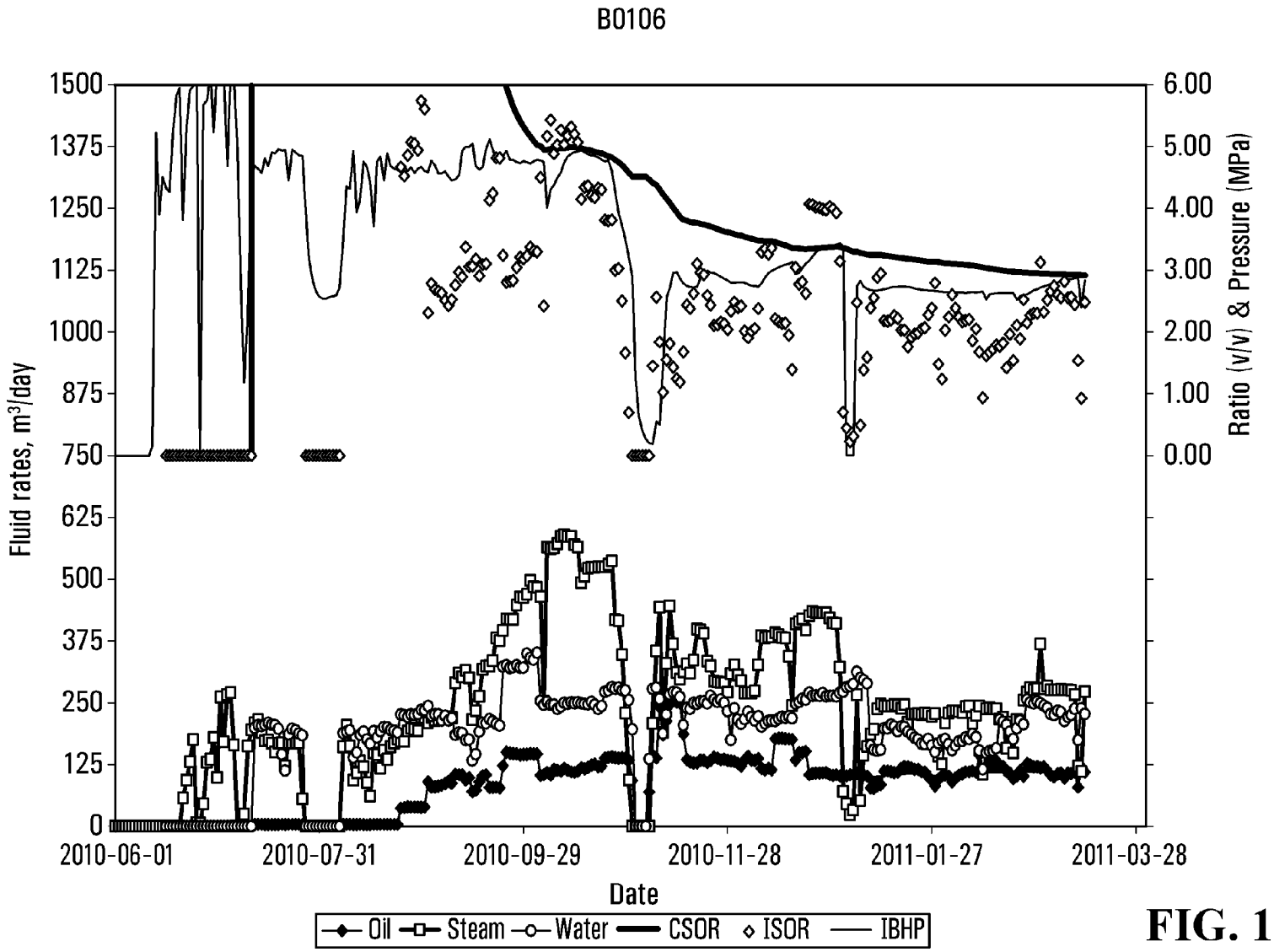
FIG. 11 is a line graph showing the oil production results following the dilation start-up process at the first well pair.

The temperature data measured from the thermocouples in the wells during the water dilation process is shown in FIG. 10, which indicated that the initial communication zone created by water dilation between the wells was limited to near the heel portion of the well. In particular, only the temperatures at the thermocouples located closest to the heels of the wells (at 685 m for the producer and 826 m for the injector) rose quickly at about the same time, indicating substantial fluid flow change at these locations due to communication. The temperatures at other locations remained flat, indicating the lack of fluid communication between the wells at these locations.

Further attempts to enlarge or expand the dilated zone with water injection did not result in observable further dilation or expansion of the dilated zone.

Steam dilation was next performed for 18 days of net injection. Steam was circulated in each well during this period at BHP much higher than 5 MPag. The circulation steam heated up the bitumen in the inter-well region and promoted further dilation between the wells. The pressure response (see FIG. 7) and temperature measurements indicated further, albeit limited, expansion of the dilated zone.

After 18 days of steam circulation (dilation), the wells were operated in gas lift mode for oil production according to typical SAGD operations procedures. The oil production performance of B01-6 is shown in FIG. 5, which shows data for oil production rates, steam injection rates, water injection rates, CSOR, and instantaneous steam-to-oil ratio (ISOR).

The start-up duration was 22 days and the CSOR after 3 months of gas lift operations was 7.5. During the start-up procedure, the gross volume of water injection was 560 $m^3$. The gross volume of steam injection was 3300 $m^3$ CWE (cold water equivalent). The net injected water was 350 $m^3$, and the net injected steam was 2245 $m^3$ CWE. The maximum rates injected were 500 $m^3$/day during water dilation and 300 $m^3$/day CWE during steam dilation. The maximum wellhead pressure was at 7 MPag during water dilation and 9 MPag during steam dilation.

The dilated zone in B01-6 was mostly near the heels of the wells and was not uniformly distributed over the length of the wells from heel to toe. Only about 13 m of the horizontal section of the well was found to open to fluid flow.

However, this example showed that it is possible to limit dilation zone within a confined region in a McMurray formation with high steam pressure and low injection volume. This test also showed that it is possible to dilate or expand a dilated zone by steam circulation at sufficiently high pressures.

Example III

Dilation Start-Up at B01-5

Start-up at another well pair (denoted as B01-5) on the B01 pad was conducted with steam circulation dilation.

For the dilation start-up procedure, coiled tubing instrumentation string containing 6 thermocouple points equally spaced along the length of the liner were added to the standard well completion inside the inner tubing string of the injection well. The wells were completed as shown in FIG. 6.

The well was initially subjected to steam circulation at steady, low BHP pressures (below or about 4 MPa) for 15 days.

Steam was then circulated in the wells at substantially steady state at pressures of about 5 MPa. Nitrogen gas was injected during this stage, which allowed direct measurement of the BHP. The BHP in each well was calculated based on the wellhead casing pressure and an estimated hydrostatic pressure gradient for nitrogen at the measured casing temperature. The measured BHP and injection rates are shown in FIGS. 12, 13, 14, and 15.

Figure 12:
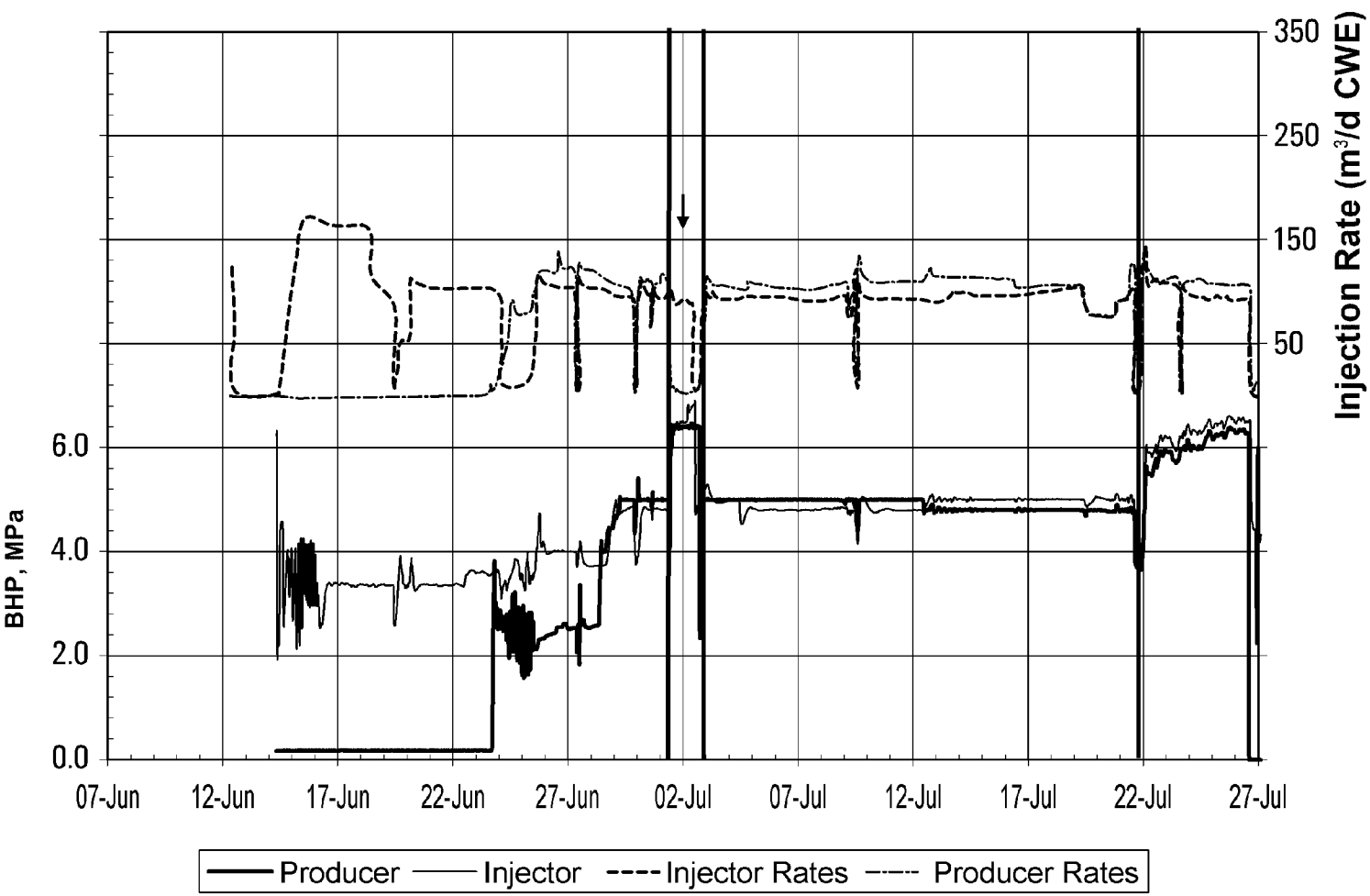
FIGS. 12, 13, 14, and 15 are line graphs showing the BHP and injection rate profiles for a dilation start-up process at a second well pair, exemplary of an embodiment of the present invention.
Figure 13:
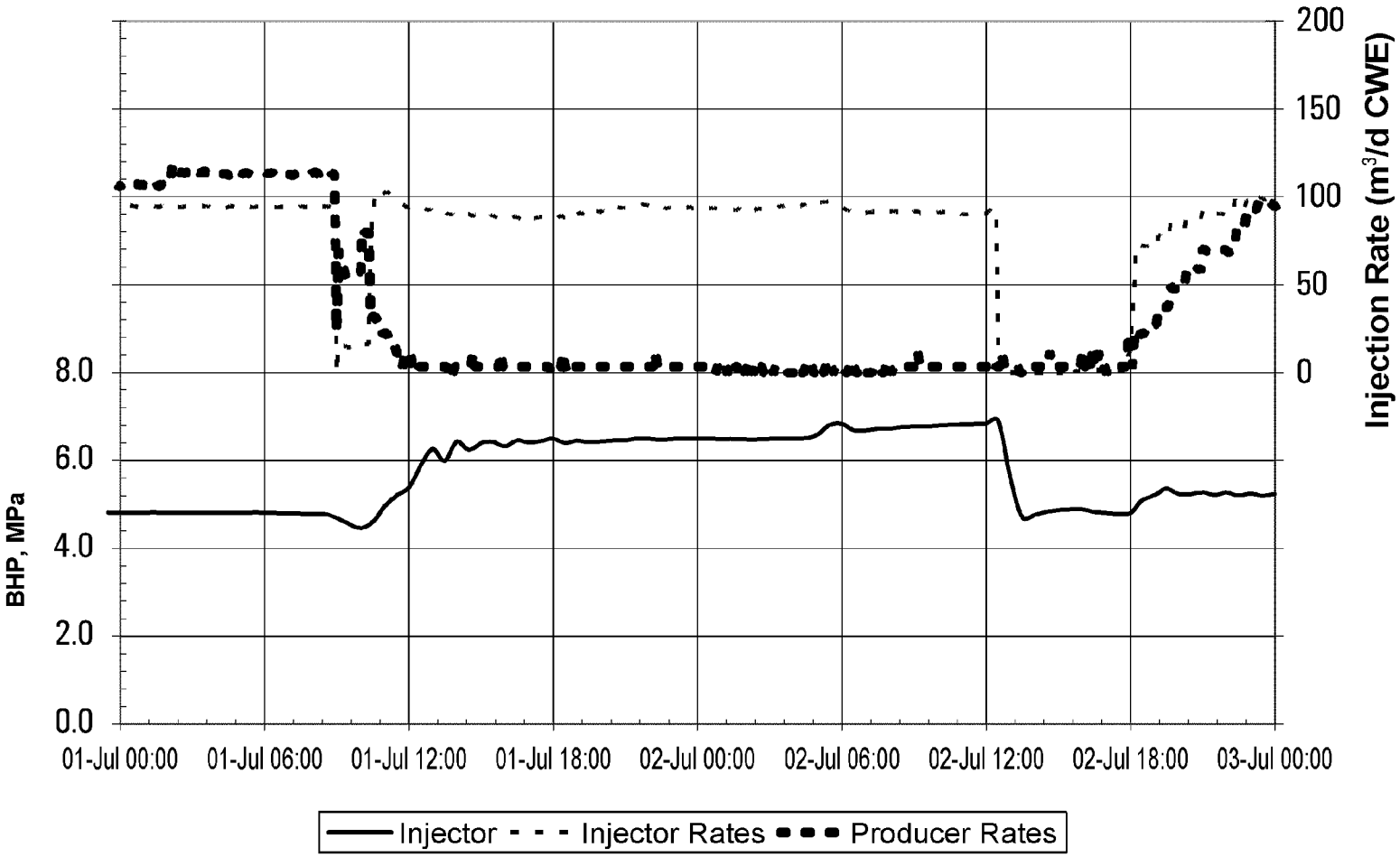
Figure 14:
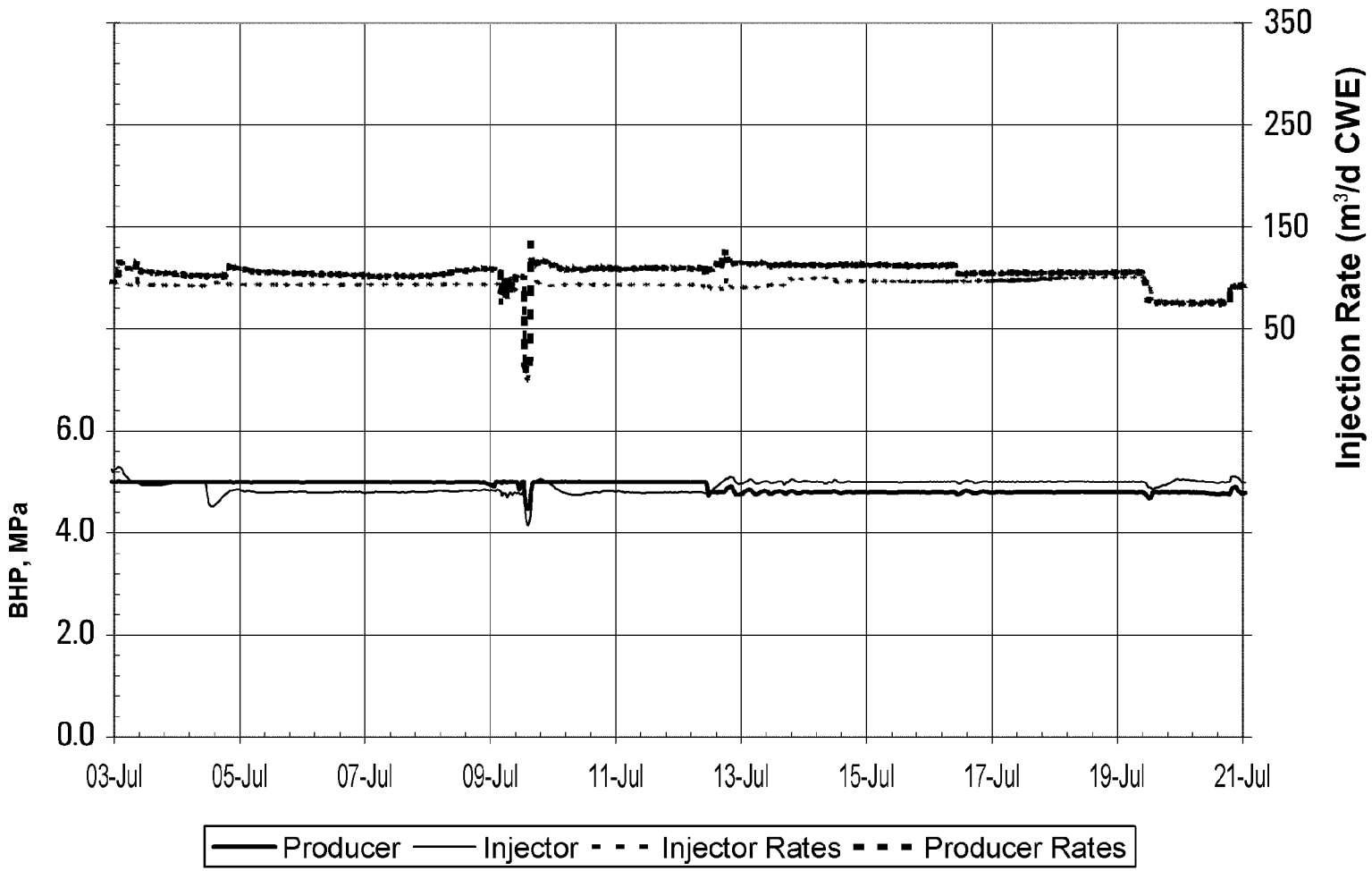
Figure 15:
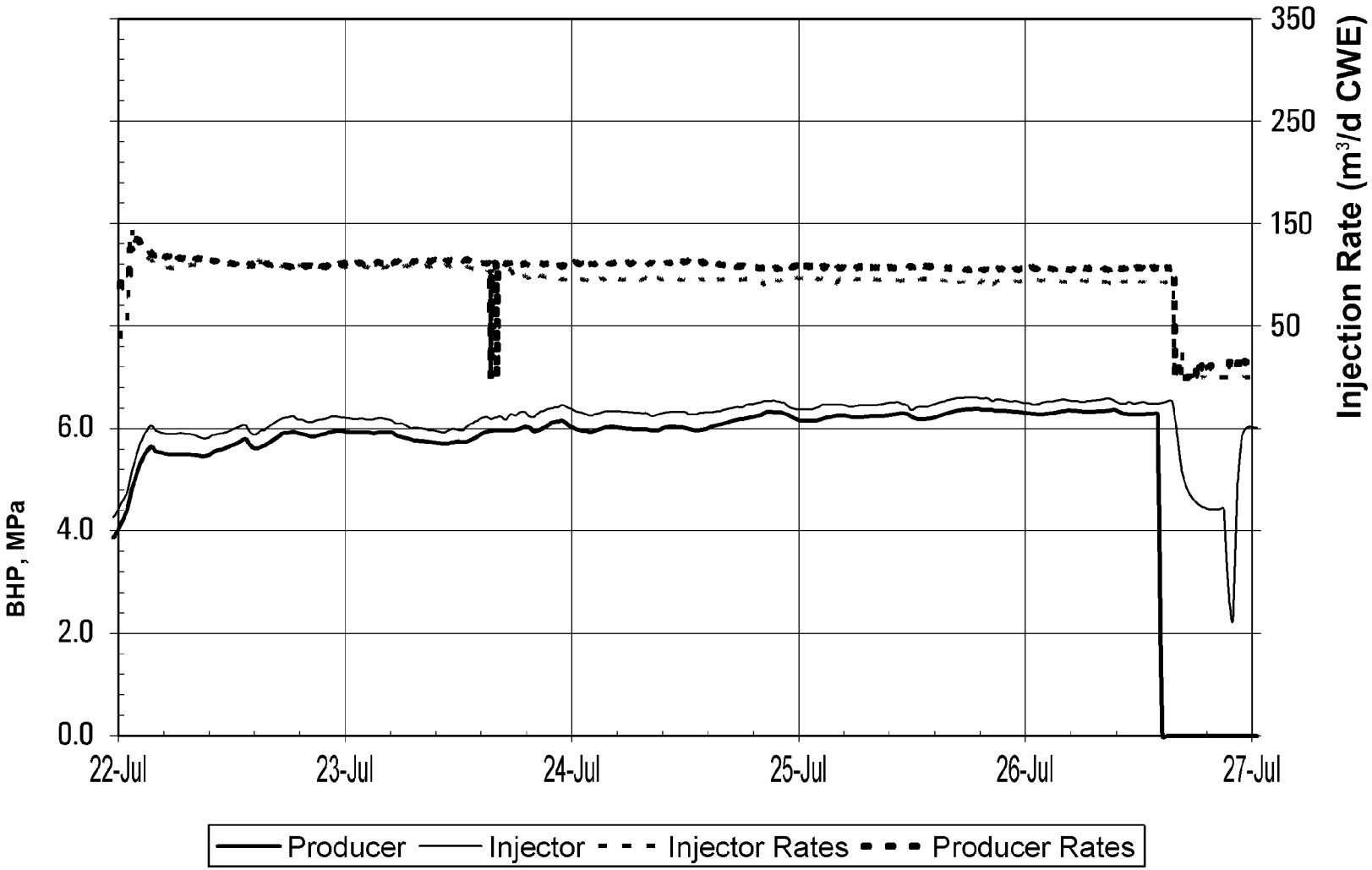

While steam circulation was generally maintained during the dilation periods, the return valves were at times temporarily closed due to operational reasons such as instrumentation malfunction, maintenance, or other reasons. During one of such return valve closures, the BHP in both wells rose substantially as can be seen in FIGS. 12 and 14 at 01-July (about 17 days after initial steam circulation), and then dropped sharply after about 6 hours of pressure ramping up when the return valves were opened up to allow flow from the casing. The BHP peaked at about 6.9 MPa. The initial breakdown and dilation occurred during this period. During the initial steam circulation at low pressures, the gross steam injection volume was about 2,500 $m^3$ CWE, and the net injection volume was nil. The net steam injection volume during the 6 hours of initial dilation period was about 20 $m^3$ CWE.

Steam circulation after the initial breakdown resulted in the observed fluid communication between the well pair (as indicated by a simultaneous substantial dip in both the BHP and injection rate, see FIGS. 12 and 14), after which the BHP was stabilized at about 5 MPa. A pressure difference between the wells was maintained during this period. During this period of about 20 days of steam circulation, the gross steam injection volume was about 3,800 $m^3$ CWE, and the net steam injection volume was nil.

Next, the BHP in each well was again increased, initially at a faster rate until reaching about 5.6 MPa and at a slower rate thereafter, while maintaining a 200 kPa pressure difference ($\Delta P$) between the wells, to further enlarge the dilated zone between the wells, and to promote improved communication through the dilated inter-well region. This stage of steam dilation continued for 5 days, and the maximum BHP reached was about 6.5 MPa. Steam was circulated during this stage at substantially steady rates as better shown in FIG. 15. During this period of about 5 days of dilation, the gross steam injection volume was about 900 $m^3$ CWE and the net steam injection volume was about 50 $m^3$ CWE. Further dilation of the formation was indicated by the drops in BHP as better shown in FIG. 15.

Figure 16:
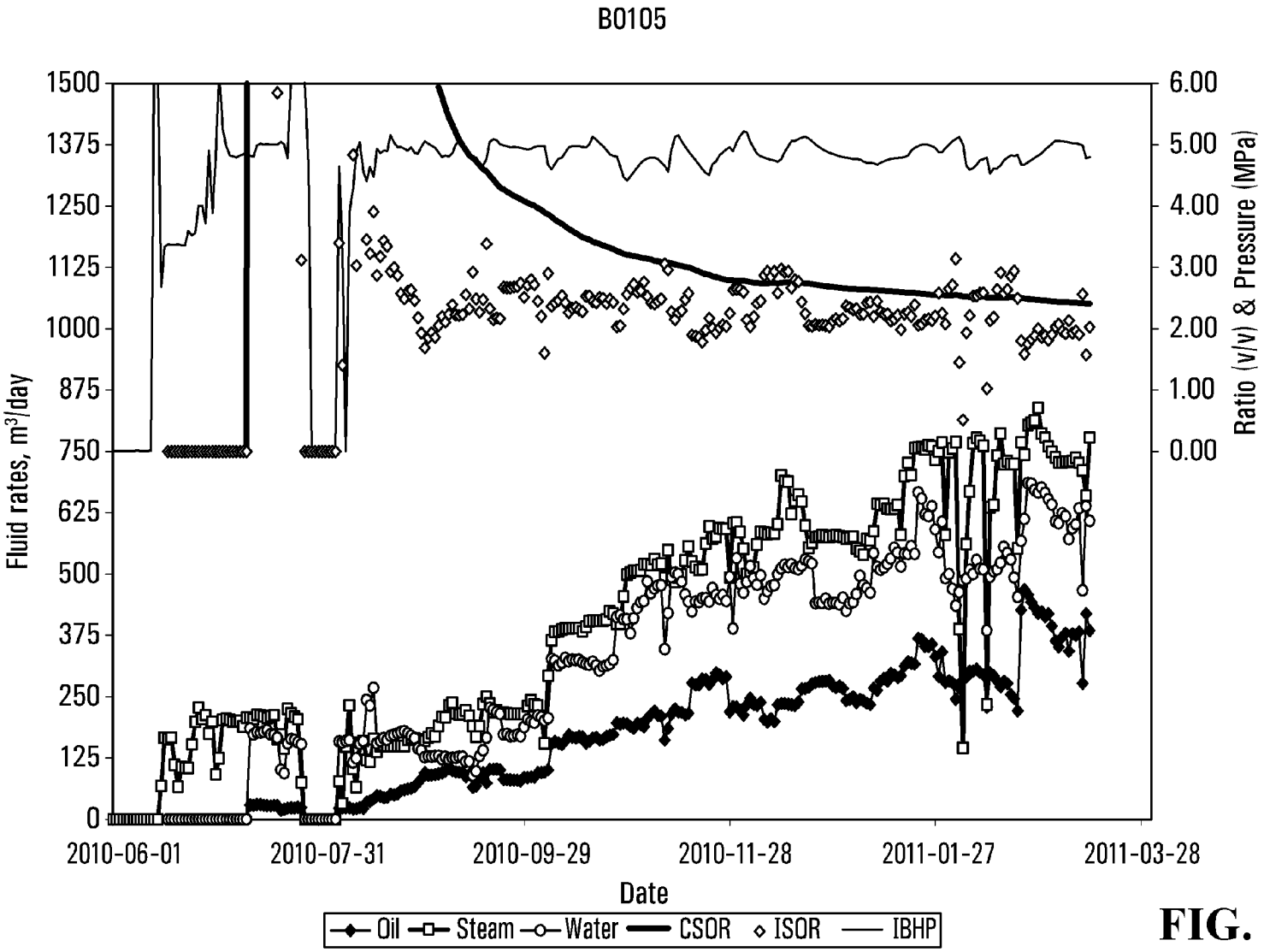
FIG. 16 is a line graph showing the oil production results following the dilation start-up process at the second well pair.

The well pair was then operated normally for SAGD steam chamber development and oil production. The ramping up of oil production performance is shown in FIG. 16. Surprisingly, although the initial start-up process for establishing communication between the well pair of B01-5 took longer than with water dilation for the well pair of B01-6, the oil production rate at well pair B01-5 increased much faster than at B01-6 over the first three months.

The total steam injected during the start-up at B01-5 was 6,300 $m^3$ CWE, the start-up duration was 43 days and the CSOR after 3 months of gas lift operations was 4.9. The net injected steam during the start-up was 70 $m^3$ CWE.

Analysis of Results

Figure 17:
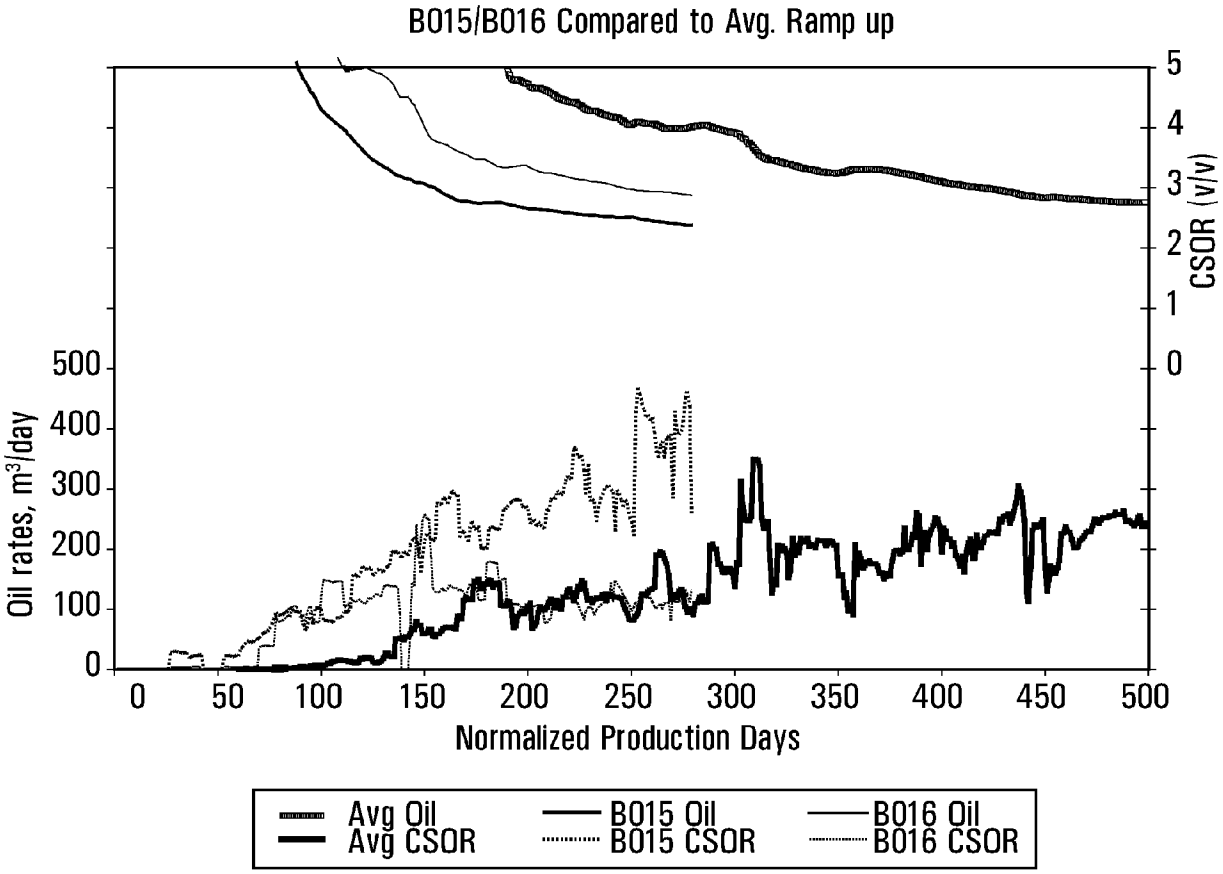
FIG. 17 is a line graph comparing the oil production performance following different start-up processes.

FIG. 17 compares the oil production results following the dilation processes of Examples I, II and III (i.e. for well pairs B01-1-3, B01-6, and B01-5 respectively). The values for well pairs B01-1 to B01-3 were average values for the three well pairs. As can be seen, the daily oil production rate increased much faster at B01-5 than at B01-6, and B01-1 to B01-3. The CSOR was lowest for B01-5, and highest for the average of B01-1 to B01-3.

Table I compares the performance results for Examples I, II and III. The test results showed, as compared to start-up with conduction heating by steam circulation at low pressures, the dilation start-up methods reduced the gross steam injected during start-up by about 70% to about 80%; reduced the time required to complete the start-up procedure by about 50% to about 75%; and reduced the CSOR after 3 months of gas lift operation by about 25% to about 50%.

As compared to the dilation start-up process in Example III, the dilation process in Example II required less water (steam) and time to complete the start-up. However, the CSOR after 3 months of operation was much smaller in Example III as compared to Example II. Further, the oil production rate increased much more quickly following the start-up procedure in Example III (see FIG. 17).

Further comparison data of the different start-up processes is shown in Table I.

TABLE I

| Comparison of different start-up procedures | | | |
|---|---|---|---|
| | Well Pair | | |
| | B01-1 to B01-3 | B01-6 | B01-5 |
| | Start-up method | | |
| | Conduction Heating | Water Dilation | Steam Dilation |
| Steam injected during start-up ($m^3$) | 20,000 | 3,300 | 6,300 |
| Duration of time for start-up (day) | 90 | 22 | 43 |
| CSOR after 3 months of gas lift operation | 10.5 | 7.5 | 4.9 |
| Maximum BMP (MPag) | 5.0 | 7.6 | 6.9 |
| Maximum Wellhead Pressure (MPag) | 9 | 9 | 9 |
| Maximum rate of Injection ($m^3$/day) | 500 | 500 | 300 |
| Net rate of injection ($m^3$) | 0 | 350 | 70 |

Example IV

Dilation Start-Up at B01-7

The start-up procedure at another well pair (denoted as B01-7) on the B01 pad was conducted with a water circulation dilation process. It was expected that the dilation (or fracture) plane would be in the vertical direction in the formation surrounding this well pair. The breakdown pressure of the formation was about 8.2 MPa, as determined from the surface pressure of the well casing and the hydrostatic head of the water in the well at the time of breakdown.

The producer well and the injector well were completed as shown in FIG. 6.

Figure 18:
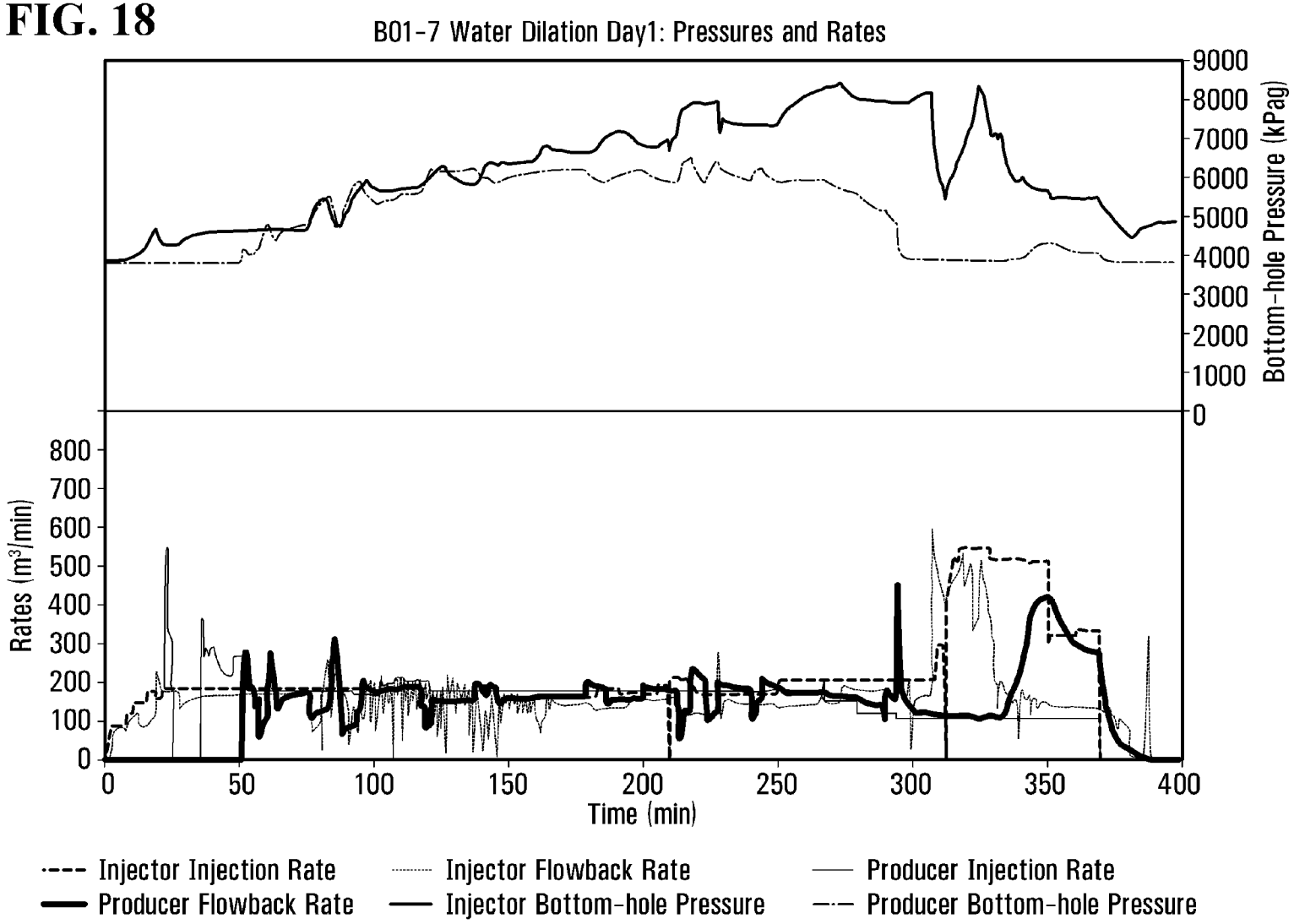
FIGS. 18 and 19 are line graphs showing measured pressures and flow rates for a dilation start-up process at a third well pair, exemplary of an embodiment of the present invention.
Figure 19:
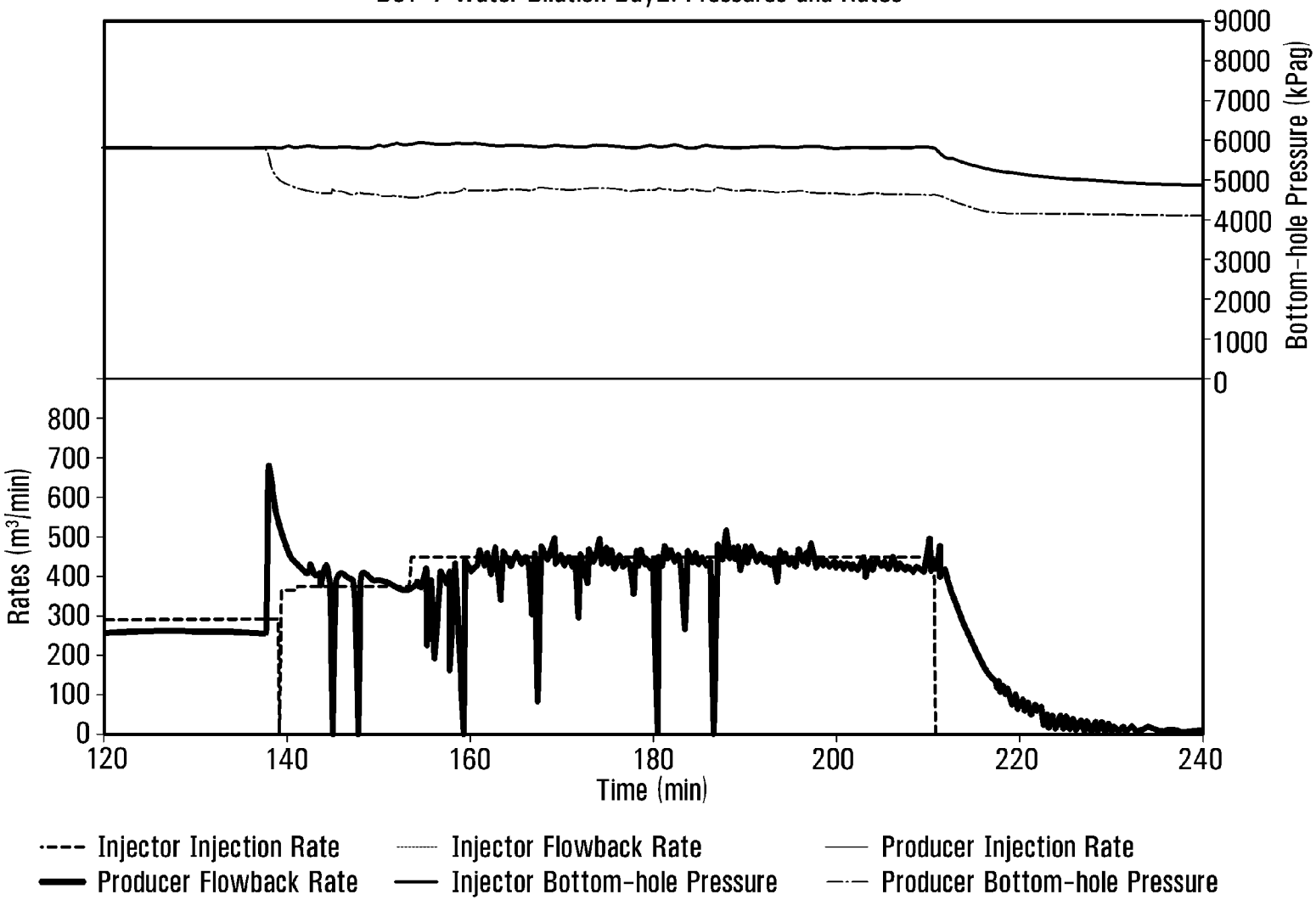
Figure 20:
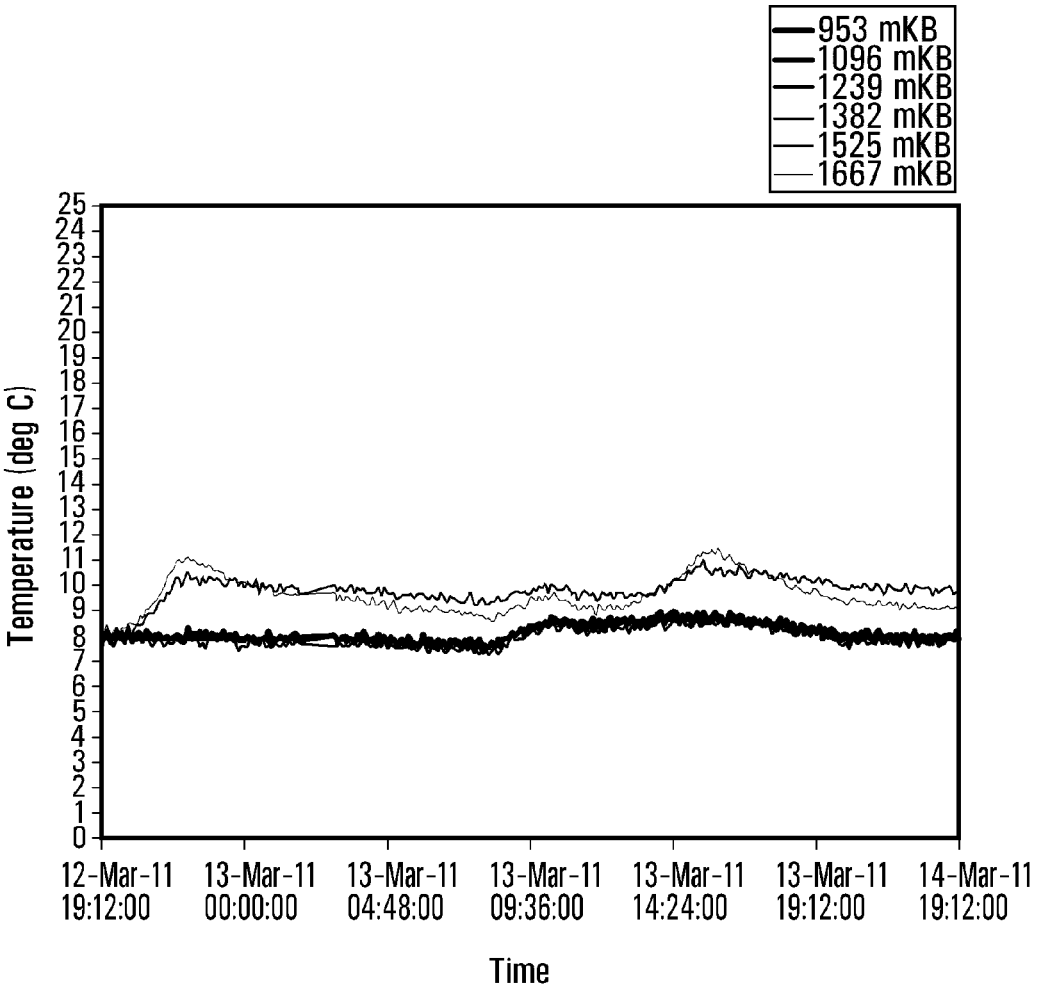
FIG. 20 is a line graph showing the measured temperatures in the third well pair during the dilation start-up process of FIGS. 18 and 19.

Water was circulated in both the injector and the producer at high flow rates with BHP profiles as shown in FIGS. 18 (showing pressure and rate measurements for the first day of water circulation) and 19 (showing pressure and rate measurements for the second day of water circulation). In FIGS. 18 and 19, the top parts of the graphs reflect the bottom-hole pressures and the lines on the bottom parts of the graphs show the rates of injection and rates of production respectively as indicated in the figure legends. The injected water had a temperature of about 80° C. The temperature measurement results are shown in FIG. 20, which were measured using thermocouples distributed in the producer well.

As can be seen in FIG. 18, the BHP in the injector was initially increased to about 4.5 MPa and held constant for two hours. Water circulation in the producer began after one hour of circulation in the injector, and the BHP in the producer was also increased to 4.5 MPa and held constant for one hour. The BHP in both wells was incremented together by 0.5 MPa every 30 minutes thereafter until reaching 6 MPa. After the BHP reached 6 MPa, as it was closer to the dilation (and fracture) pressure, the BHP in the injector was incremented more slowly, at 0.200 kPa each step, and held steady for 30 minutes before the next increment, while the BHP in the producer was held constant at 6 MPa. The BHP in the injector was increased until breakdown was detected, which occurred at about 8.2 MPa. At the same time, as the injector pressure was increased to the breakdown pressures, the producer bottom-hole pressure was decreased down to approximately 4.0 MPa to increase the pressure differential between the wells. Once breakdown occurred, the BHP in injector was decreased to about 5.8 MPa, and the BHP in the producer was maintained below the BHP of the injector, at about 4 MPa. The water circulation in the injector was controlled to maintain a constant injection rate. The dilated region was enlarged and expanded for about one hour before detection of fluid communication between the wells, which was indicated by a drop in BHP in both wells and the fact that the BHP in the producer began to track the BHP in the injector.

The water injection rates were maintained at from about 100 to about 360 L/min in the injector and at about 100 L/min in the producer (see FIGS. 18 and 19).

After the dilated region was expanded over the full length of the wells, the BHP in both wells was further decreased to below the minimum stress in the formation for a period.

As shown in FIG. 19, the BHP in the wells was later increased again to about 5.7 MPa with a pressure differential between the wells for a period of about 6 hours to expand the dilated inter-well region.

The temperature distribution in the wells was relatively uniform to within about 1° C. from heel to toe, as shown in FIG. 20. Small temperature deviations were likely mainly due to heat loss to the overburden or formation.

The maximum BHP during dilation was 8.2 MPag. After two days of dilation, the cumulative water injected was 398.5 $m^3$ and the cumulative water produced was 365 $m^3$. The net injected water volume was thus about 29 $m^3$.

It will be understood that any singular form is intended to include plurals herein. For example, the word "a", "an" or "the" is intended to mean "one or more" or "at least one." Plural forms may also include a singular form unless the context clearly indicates otherwise.

It will be further understood that the term "comprise", including any variation thereof, is intended to be open-ended and means "include, but not limited to," unless otherwise specifically indicated to the contrary.

When a list of items is given herein with an "or" before the last item, any one of the listed items or any suitable combination of two or more of the listed items may be selected and used. For any list of possible elements or features provided in this specification, any sub-list falling within the given list is also intended.

Similarly, any range of values given herein is intended to specifically include any intermediate value or sub-range within the given range, and all such intermediate values and sub-ranges are individually and specifically disclosed.

Of course, the above described embodiments are intended to be illustrative only and in no way limiting. The described embodiments are susceptible to many modifications of form, arrangement of parts, details and order of operation. The invention, rather, is intended to encompass all such modification within its scope, as defined by the claims.

What is claimed is:

1. A method of establishing fluid communication between a well pair in an oil-sand reservoir during a startup stage of a steam assisted gravity drainage process, the reservoir comprising dilatable oil sands forming a barrier to fluid communication between the well pair, the wells in the well pair each having a section that extends substantially in a horizontal direction of from about 500 m to about 1500 m in length, the substantially horizontal sections of the wells being substantially parallel and spaced vertically apart by from about 3 m to about 8 m, and wherein fluid communication is established in an inter-well region between the substantially horizontal sections, the method comprising:

a) circulating steam within a well of the well pair to apply a steam pressure to a region of the oil sands adjacent to the well and to heat the inter-well region by conduction to achieve a substantially uniform temperature distribution along the horizontal section of the well within about 2° C. of steam injection temperature, wherein said circulating steam within the well comprises injecting steam into the well and producing steam from the same well;

b) while circulating steam within the well at a substantially steady state, increasing the steam pressure to a dilation pressure sufficient to dilate the oil sands in the region of the oil sands adjacent to the well, but below a fracture propagation pressure sufficient to create open channels of direct fluid communication between the wells, thereby producing a dilated region;

c) while circulating steam within the well at a substantially steady state, maintaining the steam pressure at a level sufficient to enlarge the dilated region but below the fracture propagation pressure, until detection of a signal indicative of fluid communication between the well pair; and, d) while circulating steam within the well, expanding the dilated region along the length of the horizontal section so that the inter-well region is dilated without significant fracturing.

2. The method of claim 1, comprising monitoring and adjusting a rate of steam injection into the well and a rate of steam production from the well, wherein the steam pressure is controlled by adjusting the rate of steam injection or the rate of steam production to vary a bottom-hole pressure in the well.

3. The method of claim 2, comprising adjusting the rate of steam production to vary the bottom-hole pressure in the well.

4. The method of claim 2, comprising monitoring a difference between a measure of steam injection and a measure of steam production, and reducing the steam pressure when the difference is higher than a pre-selected threshold.

5. The method of claim 4, wherein the measure is a rate or volume.

6. The method of claim 1, comprising monitoring temperatures at a plurality of locations in the well, and, in b) and c) circulating steam through the well at a sufficiently high circulation rate such that the temperatures are substantially uniform.

7. The method of claim 1, wherein steam is circulated through the well at a circulation rate of more than 50 ton/day in b) and c).

8. The method of claim 1, comprising, prior to b), circulating steam within the well at a circulation rate and steam pressure sufficient to heat the region of oil sands by heat conduction; and prior to b), increasing the circulation rate to a sufficient level to establish a substantially uniform temperature distribution along a length of the well.

9. The method of claim 1, wherein the steam pressure in c) is selected to maintain a conservation of steam circulated through the well.

10. The method of claim 1, wherein the dilation pressure is a formation breakdown pressure higher than the minimum in situ stress in the region.

11. The method of claim 1, wherein in b) a bottom-hole pressure in the well is increased at a rate of 10 to 1000 kPa/h.

12. The method of claim 1, wherein in b) a bottom-hole pressure in the well is incremented in steps, wherein after each increment, the bottom-hole pressure is maintained substantially constant for a pre-selected period before the next increment.

13. The method of claim 12, wherein each increment is about 500 kPa or less, and the pre-selected period is about 30 minutes or longer.

14. The method of claim 1, comprising circulating steam in each well of the well pair.

15. The method of claim 14, wherein, in c), bottom-hole pressures in the wells of the well pair are controlled such that the bottom-hole pressure in a first well of the well pair is higher than the bottom-hole pressure in a second well of the well pair, and the pressure difference between the bottom-hole pressures is sufficient to drive a fluid from the first well to the second well when fluid communication is established between the well pair.

16. The method of claim 15, wherein the rates of steam injection and steam production of the first and second wells are monitored to provide the signal indicative of fluid communication between the well pair.

17. The method of claim 15, wherein the bottom-hole pressure in at least one of the first and second wells is monitored to provide the signal indicative of fluid communication between the wells.

18. The method of claim 14, comprising, after a signal indicative of fluid communication between sections of the well pair has been detected, continuing circulating steam in each well of the well pair and maintaining steam pressures in the wells at the level sufficient to enlarge the dilated region between the wells, so as to lengthen the sections of the wells between which there is fluid communication.

19. The method of claim 1, comprising injecting xylene into the region between the well pair.

20. A method of establishing fluid communication between a well pair in an oil-sand reservoir during a startup stage of a steam assisted gravity drainage process, the reservoir comprising dilatable oil sands forming a barrier to fluid communication between the well pair, the wells in the well pair each having a section that extends substantially in a horizontal direction of from about 500 m to about 1500 m in length, the substantially horizontal sections of the wells being substantially parallel and spaced vertically apart by from about 3 m to about 8 m, and wherein fluid communication is established in an inter-well region between the substantially horizontal sections, the method comprising:

a) circulating water or steam within a well of the well pair to apply a water or steam pressure to a region of the oil sands adjacent to the well and to heat the inter-well region by conduction to achieve a substantially uniform temperature distribution along the horizontal section of the well within about 2° C. of steam injection temperature, wherein said circulating water or steam within the well comprises injecting water or steam into the well and producing water or steam from the same well;

b) while circulating water or steam within the well at a substantially steady state, increasing the water or steam pressure to a dilation pressure sufficient to dilate the oil sands in the region of the oil sands adjacent to the well, but below a fracture propagation pressure sufficient to create open channels of direct fluid communication between the wells, thereby producing a dilated region;

c) while circulating water or steam within the well at a substantially steady state, maintaining the water or steam pressure at a level sufficient to enlarge the dilated region but below the fracture propagation pressure, until detection of a signal indicative of fluid communication between the well pair; and d) while circulating water or steam within the well, expanding the dilated region along the length of the horizontal section so that the inter-well region is dilated without significant fracturing.

21. The method of claim 20, wherein the water or steam is water.

22. The method of claim 20, wherein the water or steam in b) is water, and the water or steam in c) comprises steam.

23. The method of claim 20, wherein the water is heated before the water is injected into the well.

24. The method of claim 20, wherein the water being injected into the well is at a temperature of about 50 to about 100° C.

* * * * *